US009863434B2

(12) United States Patent
Elsner

(10) Patent No.: US 9,863,434 B2
(45) Date of Patent: Jan. 9, 2018

(54) FINS, TUBES, AND STRUCTURES FOR FIN ARRAY FOR USE IN A CENTRIFUGAL FAN

(71) Applicant: Steven C. Elsner, Tonopah, AZ (US)

(72) Inventor: Steven C. Elsner, Tonopah, AZ (US)

( * ) Notice: Subject to any disclaimer, the term of this patent is extended or adjusted under 35 U.S.C. 154(b) by 6 days.

(21) Appl. No.: 14/943,198

(22) Filed: Nov. 17, 2015

(65) Prior Publication Data

US 2016/0069618 A1 Mar. 10, 2016

Related U.S. Application Data

(63) Continuation-in-part of application No. 13/355,327, filed on Jan. 20, 2012, now Pat. No. 9,243,650, which is a continuation-in-part of application No. 11/545,210, filed on Oct. 10, 2006, now Pat. No. 8,104,306.

(60) Provisional application No. 60/725,559, filed on Oct. 11, 2005.

(51) Int. Cl.

| | |
|---|---|
| ***F04D 29/42*** | (2006.01) |
| ***F04D 29/58*** | (2006.01) |
| ***F24F 1/00*** | (2011.01) |
| ***F28D 9/00*** | (2006.01) |
| ***F28D 9/04*** | (2006.01) |

(52) U.S. Cl.

CPC ..... *F04D 29/4213* (2013.01); *F04D 29/582* (2013.01); *F24F 1/0007* (2013.01); *F24F 1/0022* (2013.01); *F24F 1/0059* (2013.01); *F28D 9/0012* (2013.01); *F28D 9/04* (2013.01)

(58) Field of Classification Search

None

See application file for complete search history.

(56) References Cited

U.S. PATENT DOCUMENTS

| | | | |
|---|---|---|---|
| 2,454,654 | A | 11/1948 | Kaufman |
| 3,788,281 | A | 1/1974 | Van Lookeren Campagne |
| 3,973,718 | A | 8/1976 | Deschamps |
| 4,321,803 | A | 3/1982 | Smith |

(Continued)

FOREIGN PATENT DOCUMENTS

| | | | |
|---|---|---|---|
| EP | 00362163 | A1 | 3/1981 |
| JP | 02-195175 | A | 8/1990 |

OTHER PUBLICATIONS

USPTO; Non-Final Office Action dated Nov. 26, 2008 in U.S. Appl. No. 11/545,210.

(Continued)

*Primary Examiner* — Etsub Berhanu
*Assistant Examiner* — Nelson Nieves
(74) *Attorney, Agent, or Firm* — Snell & Wilmer L.L.P.

(57) ABSTRACT

A fin array is disclosed for use in a centrifugal fan having a housing and a fan wheel, the fin array having: a first tube in a first plane perpendicular to an axis of the fan wheel; a second tube in a second plane parallel to the first plane; and a fin in a third plane parallel to the first plane. The fin is sandwiched between the first tube and the second tube, all of which partially surround the axis of the fan wheel. The fin comprises a slotted fin apparatus for permitting condensate to move from a region between the fan wheel and the first tube to a region between the first tube and the housing. The slotted fin apparatus has a first cutout disposed between a first extension and a second extension along at least a portion of the length of the fin.

10 Claims, 27 Drawing Sheets

(56) References Cited

U.S. PATENT DOCUMENTS

| | | | | |
|---|---|---|---|---|
| 4,479,366 | A | 10/1984 | Lanier et al. | |
| 4,615,176 | A | 10/1986 | Tippmann | |
| 4,698,979 | A | 10/1987 | McGuigan | |
| 5,186,022 | A | 2/1993 | Kim | |
| 5,317,884 | A | 6/1994 | Lyon | |
| 5,383,337 | A | 1/1995 | Baker | |
| 5,568,835 | A | 10/1996 | LaCount et al. | |
| 5,893,705 | A | 4/1999 | Khan et al. | |
| 6,145,479 | A | 11/2000 | Rotter | |
| 6,298,677 | B1 | 10/2001 | Bujak, Jr. | |
| 6,485,547 | B1 | 11/2002 | Iijima | |
| 6,519,966 | B1 | 2/2003 | Martin, Sr. | |
| 6,574,975 | B2 | 6/2003 | Bourne et al. | |
| 6,651,455 | B1 | 11/2003 | Yoho, Sr. | |
| 6,666,038 | B1 | 12/2003 | Hynes | |
| 6,877,615 | B2 | 4/2005 | Clark et al. | |
| 6,907,663 | B2 | 6/2005 | Yoon et al. | |
| 7,299,861 | B2 | 11/2007 | Lo | |
| 8,104,306 | B1 | 1/2012 | Elsner | |
| 2001/0045271 | A1 | 11/2001 | Li | |
| 2002/0172588 | A1 | 11/2002 | Ikeda et al. | |
| 2003/0094011 | A1 | 5/2003 | Zakryk et al. | |
| 2003/0136143 | A1 | 7/2003 | Johnson et al. | |
| 2003/0209030 | A1 | 11/2003 | Nishida et al. | |
| 2007/0246199 | A1* | 10/2007 | Lee et al. | H01L 23/467 165/122 |
| 2012/0114474 | A1 | 5/2012 | Elsner | |

OTHER PUBLICATIONS

USPTO; Non-Final Office Action dated Aug. 17, 2009 in U.S. Appl. No. 11/545,210.
USPTO; Interview Summary dated Dec. 16, 2009 in U.S. Appl. No. 11/545,210.
USPTO; Final Office Action dated Mar. 5, 2010 in U.S. Appl. No. 11/545,210.
USPTO; Advisory Action dated May 5, 2010 in U.S. Appl. No. 11/545,210.
USPTO; Non-Final Office Action dated Mar. 25, 2011 in U.S. Appl. No. 11/545,210.
USPTO; Interview Summary dated Jun. 29, 2011 in U.S. Appl. No. 11/545,210.
USPTO; Notice of Allowance dated Sep. 28, 2011 in U.S. Appl. No. 11/545,210.
USPTO; Notice of Publication dated May 10, 2012 in U.S. Appl. No. 13/355,327.
USPTO; Office Action dated Feb. 3, 2015 in U.S. Appl. No. 13/355,327.
USPTO; Applicant-Initiated Interview Summary dated May 5, 2015 in U.S. Appl. No. 13/355,327.
USPTO; Notice of Allowance dated Aug. 17, 2015 in U.S. Appl. No. 13/355,327.
USPTO; Response to Rule 312 Communication dated Jan. 4, 2016 in U.S. Appl. No. 13/355,327.

* cited by examiner

FINS, TUBES, AND STRUCTURES FOR FIN ARRAY FOR USE IN A CENTRIFUGAL FAN

RELATED APPLICATIONS

This application is a continuation-in-part of, and claims priority to U.S. Ser. No. 13/355,327 filed on Jan. 20, 2012 and entitled "FIN ARRAY FOR USE IN A CENTRIFUGAL FAN", which is a continuation-in-part of U.S. Ser. No. 11/545,210 filed on Oct. 10, 2006 and entitled "FREEZABLE SQUIRREL CAGE EVAPORATOR", which is a continuation-in-part of U.S. Provisional Application Ser. No. 60/725,559 filed Oct. 11, 2005. All of which are incorporated herein by reference in their entirety.

TECHNICAL FIELD

The present invention relates to heat exchangers used in a centrifugal fan operable in cooling or heating systems.

BACKGROUND OF INVENTION

A centrifugal fan, also referred to as a blower fan or squirrel-cage fan, is a mechanical device which brings a fluid, frequently air, into an inlet surrounding the axis of a fan wheel. The wheel forces the air out into the fan housing, creating increased pressure in the air. The air then exits though an outlet on the fan housing. Centrifugal fans have numerous applications including heating and cooling systems, and more specifically including swamp coolers. While centrifugal fans are common, compact solutions using a centrifugal fan as a heating, cooling, and/or refrigeration source are not.

SUMMARY OF THE INVENTION

As set forth in the detailed description, in accordance with various aspects of the present invention, devices and systems for heating and cooling with a centrifugal fan is disclosed. A device in accordance with the present invention generally comprises a tube and fin array in a centrifugal fan configured to operate as a heating, cooling, and/or refrigeration source.

A fin array for use in a centrifugal fan having a housing and a fan wheel is disclosed, the fin array may include a first tube in a first plane perpendicular to an axis of the fan wheel, a second tube in a second plane parallel to the first plane, and a fin in a third plane parallel to the first plane. In various embodiments, the fin, the first tube, and the second tube are partially surrounding the axis of the fan wheel, the fin having a first end and a second end, the fin having a length between the first end and the second end. In various embodiments, the fin is sandwiched between the first tube and the second tube, wherein the axis of the fan wheel is perpendicular to a plane defined by a larger surface of the fin.

The fin may include a slotted fin apparatus. The slotted fin apparatus may include a first extension and a second extension disposed along at least a portion of the length of the fin, and a first cutout disposed between the first extension and the second extension along the at least the portion of the length of the fin. The first cutout may be defined through the fin and bounded by the first extension and the second extension. The first tube and the second tube may be in parallel contact with the fin along at least a portion of the first extension.

In various embodiments, the first cutout is further bounded by a cutout floor line including an inward boundary of the first cutout. In various embodiments, the slotted fin apparatus further includes a first gap including an aperture defined by the cutout floor line, the first extension, the second extension, and at least one of the first tube and the second tube, whereby the aperture is configured to permit condensate to exit the fin array.

A heat exchanger for use in a centrifugal fan having a housing, a fan wheel, an air entrance, and an air exit is disclosed. The heat exchanger may include a plurality of tubes including at least a first tube and a second tube and a plurality of fins forming a shape similar to the housing of the centrifugal fan, wherein an inside edge of the plurality of fins is configured to substantially follow an outer circumferential profile of the fan wheel. In various embodiments, a fin of the plurality of fins is sandwiched between the first tube and the second tube. In various embodiments, the inside edge and an outside edge of the fin of the plurality of fins define the radially inward and radially outward bounds of a larger surface of the fin, wherein the larger surface of the fin is disposed primarily radially inward of the plurality of tubes and extends radially inward toward an axis of the fan wheel. In various embodiments, a recirculation scoop is disposed at least partially within an outside surface of the housing and configured to redirect a first portion of a fluid leaving a centrifugal fan outlet back into the plurality of fins.

In various embodiments, the recirculation scoop includes a circumferential member configured to direct the first portion of the fluid back into the plurality of fins, an affixment stud extending from the circumferential member and received in a radial slot, whereby the circumferential member may be selectably moved, and an affixment pivot disposed at a distal end of the circumferential member, whereby the recirculation scoop is affixed in position.

An air conditioning device is disclosed. The air conditioning device may include a first housing including an evaporative pad forming a wall of the first housing and a squirrel cage fan assembly located within the first housing for drawing air through the evaporative pad for evaporative cooling of the air drawn through the evaporative pad. The squirrel cage fan assembly may include a squirrel cage fan housing, a fan wheel, a tube/fin array disposed between the fan wheel and the squirrel cage fan housing. The tube/fin array may include a first tube and a second tube for conveying one or more heating/cooling fluid, and a fin sandwiched between the first tube and the second tube. In various embodiments, the fin, the first tube, and the second tube are substantially annular about an axis of the fan wheel. In various embodiments, the fin includes a slotted fin apparatus configured to release condensate from within the tube/fin array.

Further objects and advantages will become apparent as the following description proceeds and the features of novelty which characterize this invention will be out pointed with particularity in the claims annexed to and forming a part of this specification.

BRIEF DESCRIPTION OF THE DRAWINGS

The subject matter of the invention is particularly pointed out and distinctly claimed in the concluding portion of the specification. The invention, however, both as to structure and method of operation, may best be understood by reference to the following description taken in conjunction with the claims and the accompanying drawing figures, in which like parts may be referred to by like numerals.

DETAILED DESCRIPTION

Figure 1:
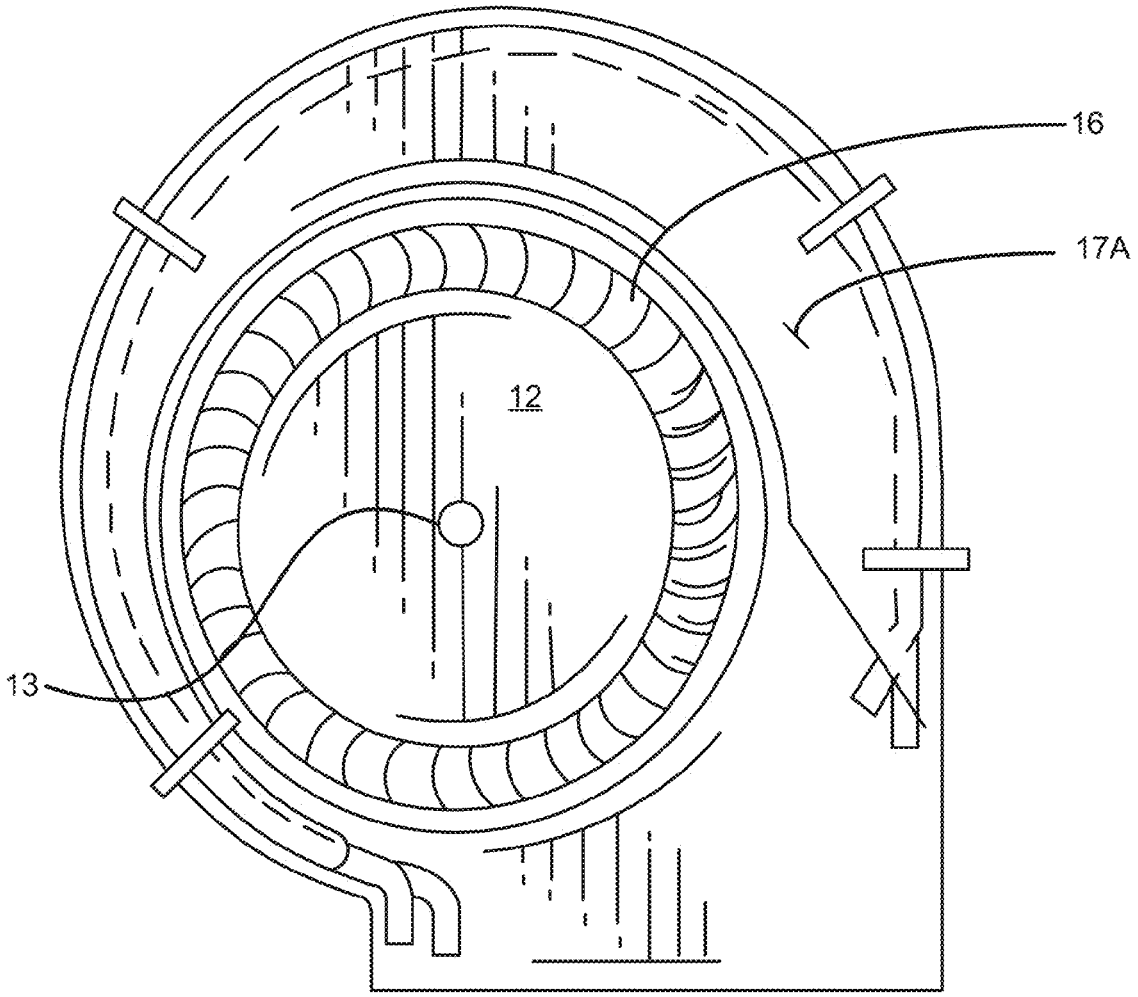
FIG. 1 is an open end view of a squirrel cage fan evaporator in accordance with various example embodiments of the present invention.
Figure 2:
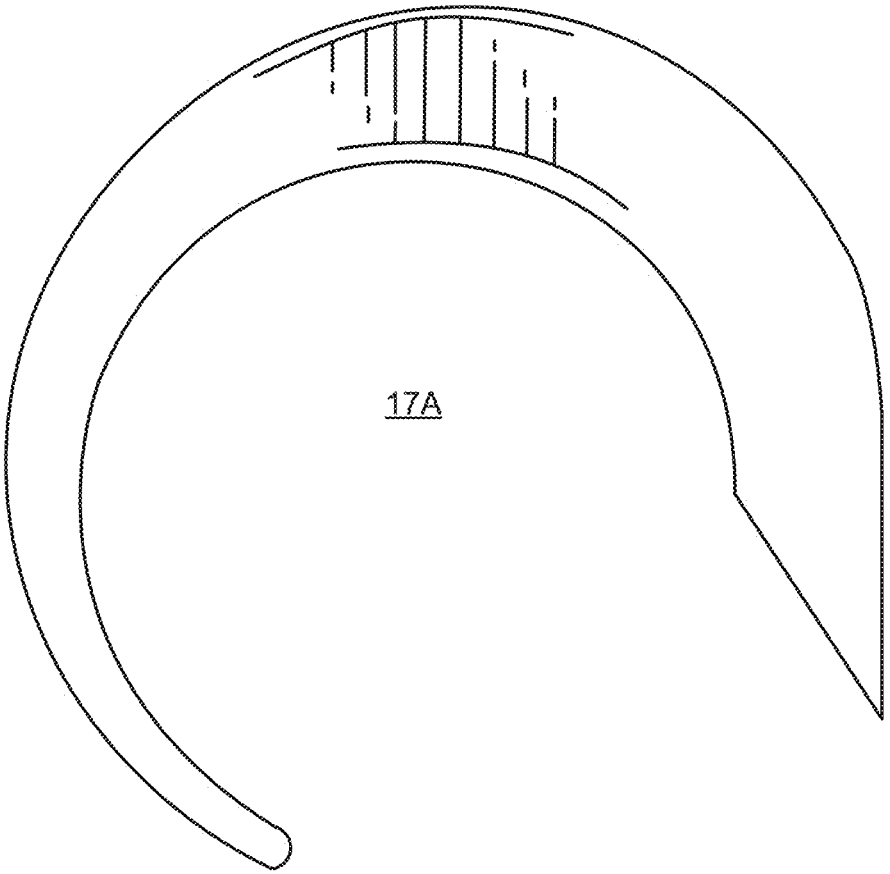
FIG. 2 is a view of one of several cooling fins from in FIG. 1 in accordance with various example embodiments of the present invention.
Figure 3:
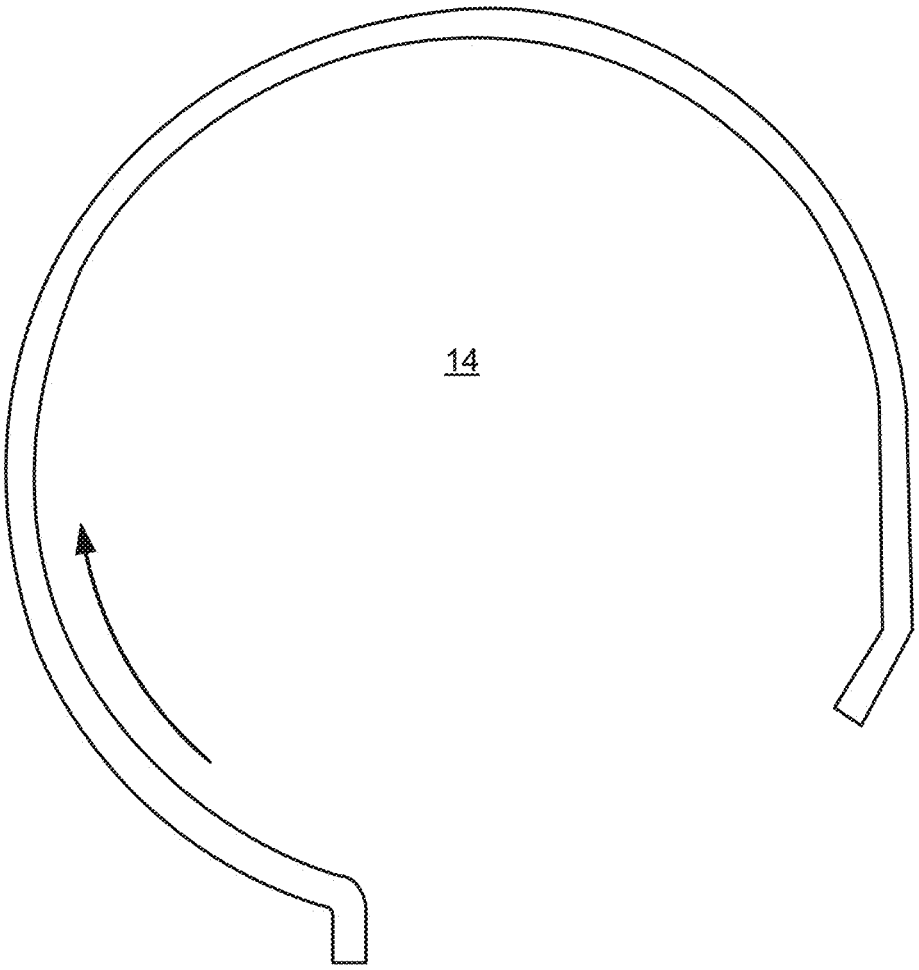
FIG. 3 is a view of an evaporator tubing of a squirrel cage fan evaporator showing refrigerant flow in a clockwise direction in accordance with various example embodiments of the present invention.
Figure 4:
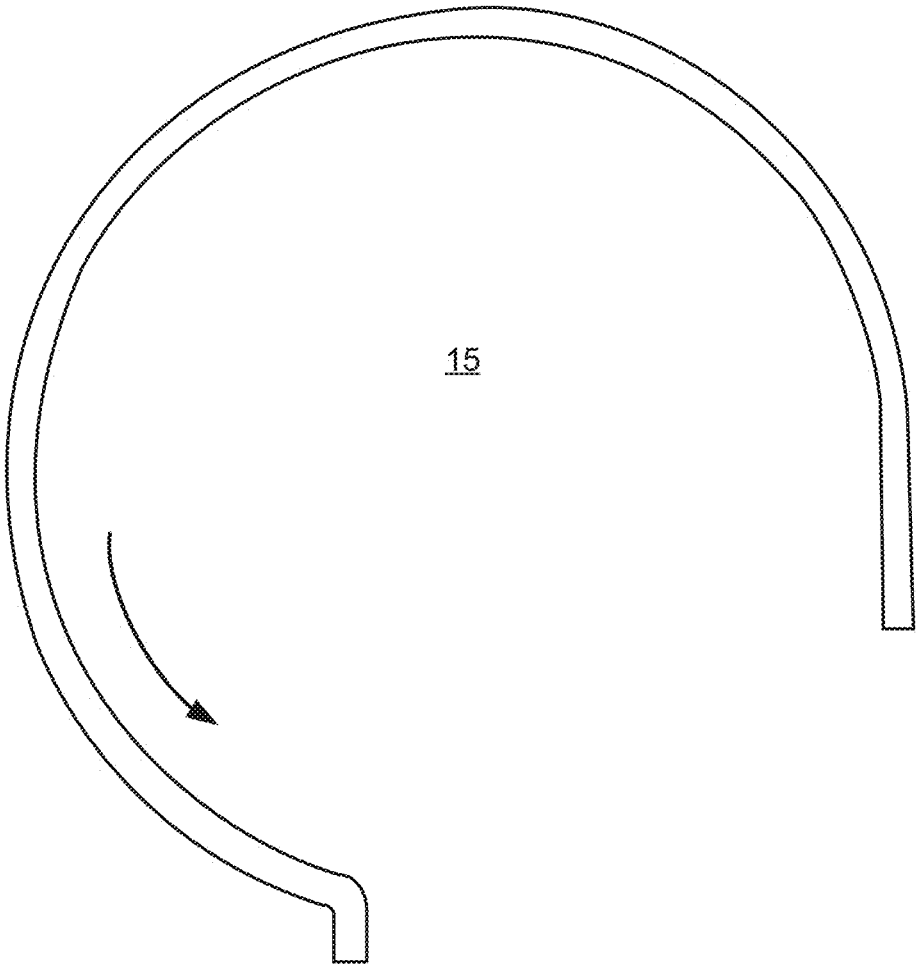
FIG. 4 is a view of an evaporator tubing of a squirrel cage fan evaporator shown in FIG. 1 showing refrigerant flow in a counter-clockwise direction in accordance with various example embodiments of the present invention.
Figure 5:
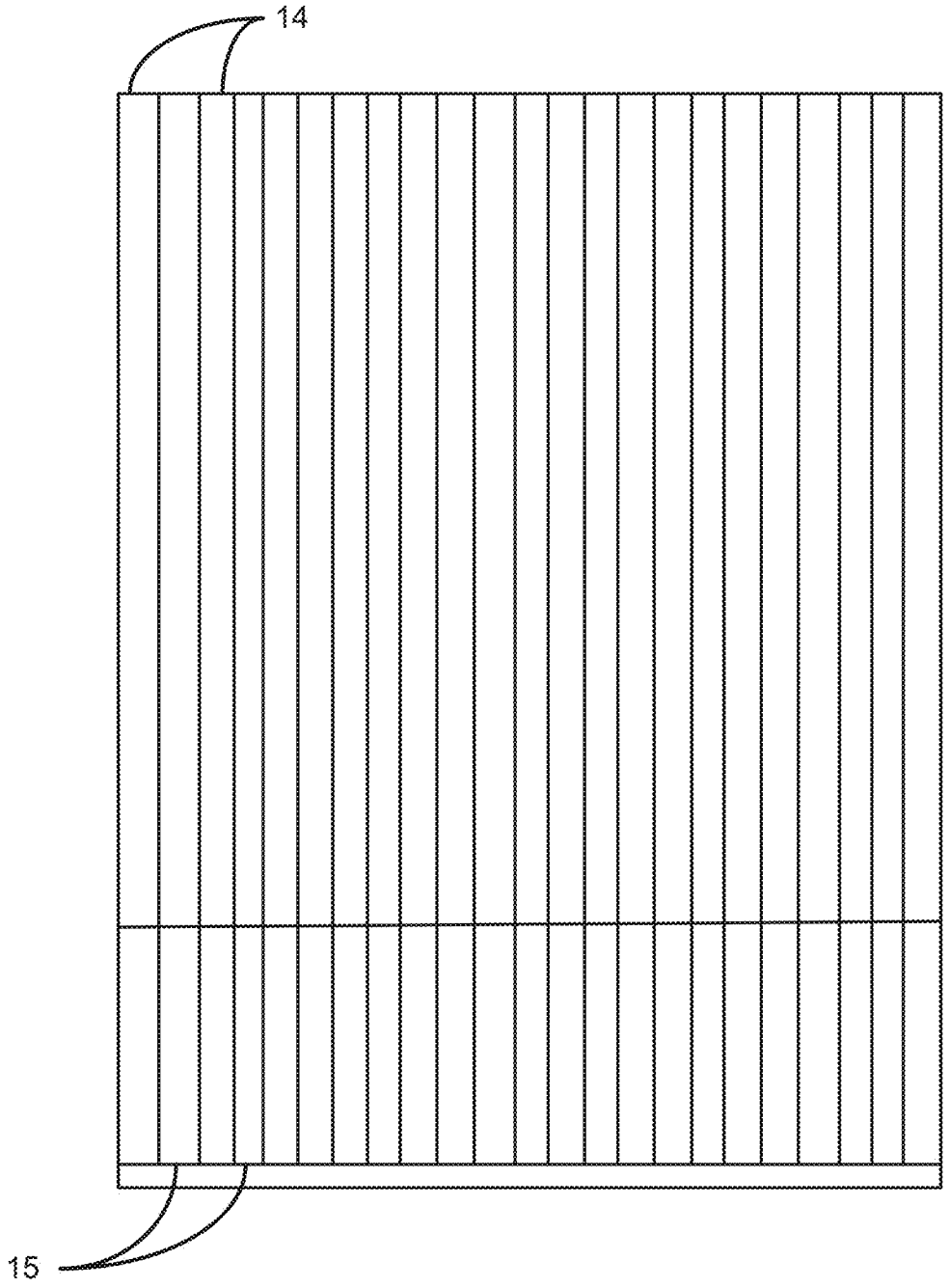
FIG. 5 is a side view of a squirrel cage fan evaporator showing evaporator tubing separated by fins and also showing liquid and suction connections to evaporator tubing in accordance with various example embodiments of the present invention.

The detailed description herein makes use of various exemplary embodiments to assist in disclosing the present invention. While these exemplary embodiments are described in sufficient detail to enable those skilled in the art to practice the invention, it should be understood that other embodiments may be realized and that modifications of structures, arrangements, applications, proportions, elements, materials, or components used in the practice of the instant invention, in addition to those not specifically recited, can be varied or otherwise particularly adapted to specific environments, manufacturing specifications, design parameters or other operating requirements without departing from the scope of the present invention and are intended to be included in this disclosure. Thus, the detailed description herein is presented for purposes of illustration only and not of limitation.

In accordance with an aspect of the present invention, a centrifugal fan may be configured as a heating or cooling system for a fluid such as air. While all fluids understood by a person of ordinary skill in the art to be operable with a centrifugal fan are contemplated herein, air is described as one particular example throughout. In accordance with an embodiment of the present invention, the centrifugal fan may include a heat exchanger that is configured to heat or cool air passing through the centrifugal fan. For example, the heat exchanger may run a fluid colder than the air pulled into the centrifugal fan, allowing the air to lose its heat to the colder fluid. In another example, the heat exchanger may run a fluid warmer than the air pulled into the centrifugal fan allowing the air pulled into the centrifugal fan to absorb the heat from the warmer fluid in the heat exchanger. In another example, the heat exchanger may be configured to operate separate tubes within the heat exchanger independently. For example, the heat exchanger may run multiple fluids simultaneously throughout the heat exchanger. The heat exchanger may also be configured to operate various tubes in multiple cycles. For example, the heat exchanger may run cold fluid in one cycle then warm fluid in a second cycle. The heat exchanger may also be configured to operate separate tubes independently while operating multiple cycles. For example, the heat exchanger may run both warm and cold fluids at the same time. The decision to run warm fluid, cold fluid, or both may be based on the desire to control various factors. The factors may include temperature, humidity, and/or ice buildup. In another example, the multiple fluids may include different types of fluids such as a refrigerant (e.g. R404), water, air, and/or any fluid recognized as beneficial by one of ordinary skill in the art. The heat exchanger may allow different types of fluids to be run at different temperatures and different physical states. For example, liquid refrigerant may be used in conjunction with gaseous water (i.e. steam). As the heat exchanger may be configured to operate separate tubes independently in multiple cycles, any combination of fluids run under any combination of different physical parameters is contemplated herein.

In accordance with an aspect of the present invention, the heat exchanger in the centrifugal fan may be a fin and tube array comprising one or more fins and one or more tubes. In accordance with various exemplary embodiments, at least one fin and tube may be in parallel contact along a significant portion of the length of the fin. For example, the fin and tube may be in parallel contact along 50% or more of the fins length. In accordance with various embodiments, the fin may be sandwiched between the two tubes. The fins may extend into the path of the air flow, configured such that the fins are at least partially parallel with the air flow coming out of the fan wheel. In this position, the fins and the tubes may be substantially annular about an axis of the fan wheel, meaning the axis of the fan wheel is perpendicular to the plane defined by the larger surface (i.e. the surface with the greatest surface area) of the fins. The tubes may be biased toward the fin edge which is farthest from the centrifugal fan wheel.

In accordance with various embodiments, the one or more fins in the array may be perpendicular to and wrap around a portion of an axis of a centrifugal fan wheel. The outside of the array may approximate the shape of the housing of the centrifugal fan. The array may form part of or all of the outer housing of the centrifugal fan. For example, the fins and tubes may be stacked in an arrangement such that the fins and tubes form a contiguous outer wall of the centrifugal fan. In various examples, the array may be manufactured by extruding the fins and tubes in a curved shape approximating a portion of the outer wall of the centrifugal fan.

In various examples, the array may comprise a plurality of fins and tubes stacked in a continuing pattern of tube, fin, tube, and fin. The continuing pattern may begin with either the tube or the fin. In accordance with the aspects and embodiments discussed above, each tube on either side of the fin may contain a different type and/or physical state of fluid.

In accordance with various embodiments of the present invention, the array may be configured such that the one or more fins occupy a space between an exterior of the centrifugal fan wheel and the centrifugal fan housing. In various examples, the fan wheel may not be centered in the housing and in response the fin may be narrow on one end and progressively widens to the second end. Similarly the space between the housing and the wheel may be a different dimension than the height of the opening; accordingly, the fin may be dimensioned so it substantially fills each space, resulting in a changing height of the fin. In various examples, the height of the second end of the fin may be substantial the same height as the vertical height of the exit of the centrifugal fan housing. In various embodiments, the fin height at the exit may be less than the full height of the exit but greater than half the height of the exit. Alternatively in other embodiments, the fin height at the exit may be less than half the height of the exit.

In accordance with an aspect of the invention, the array may be plumbed such that it is configured to operate the separate tubes independently and/or operate the separate tubes in multiple cycles. In accordance with one embodiment, the array may be configured with a switching flow. In a switching flow, a fluid may flow through at least one tube in different direction in response to different cycles. For example, in a first cycle the fluid may flow from a first end to a second end of a tube. In a second cycle the fluid may flow from the second end to the first end of the tube. In accordance with various embodiments, the array may be configured with an opposing flow. In an opposing flow, fluid may flow through a first tube in the opposite direction as compared to fluid flowing in a second tube. In accordance with various embodiments, the array may be configured with an alternating flow. In an alternating flow, fluid may flow in one tube in one cycle then in the next tube in a different cycle. In accordance with various embodiments, the array may be configured to operate in accordance with one or more of an alternating flow, an opposing flow, and a switching flow.

In accordance with various embodiments, the array may be plumbed such that each tube may run more than one fluid. For example, a tube may have a three way valve prior to entry into the arrays. The three way valve may switch fluid sources operating in the tube. In various examples, one line connecting into the array tube may be a cooled refrigerant coming from the throttling valve (or similar step in the refrigeration process), whereas the second line connecting into the array tube may be a heated refrigerant coming from a compressor (or similar step in the refrigeration process). Thus refrigerant from multiple steps in the refrigeration process can be routed through the array. In various embodiments, liquids from different sources such as water and refrigerant may be routed through the array tube via the three way valve. While many embodiments are discussed using a three way valve, any fluid switching system that accomplishes a similar purpose is contemplated herein.

In further examples, the fin and tube may be in intermittent parallel contact along a significant portion of the length of the fin. For example, cutout notches of the fin may interrupt contact of the fin and tube. Still furthermore, coining (e.g., alternate raising and/or lowering) of the fin along the portion proximate to the tube may cause the fin and tube to be in intermittent parallel contact along a significant portion of the length of the fin.

Figure 25:
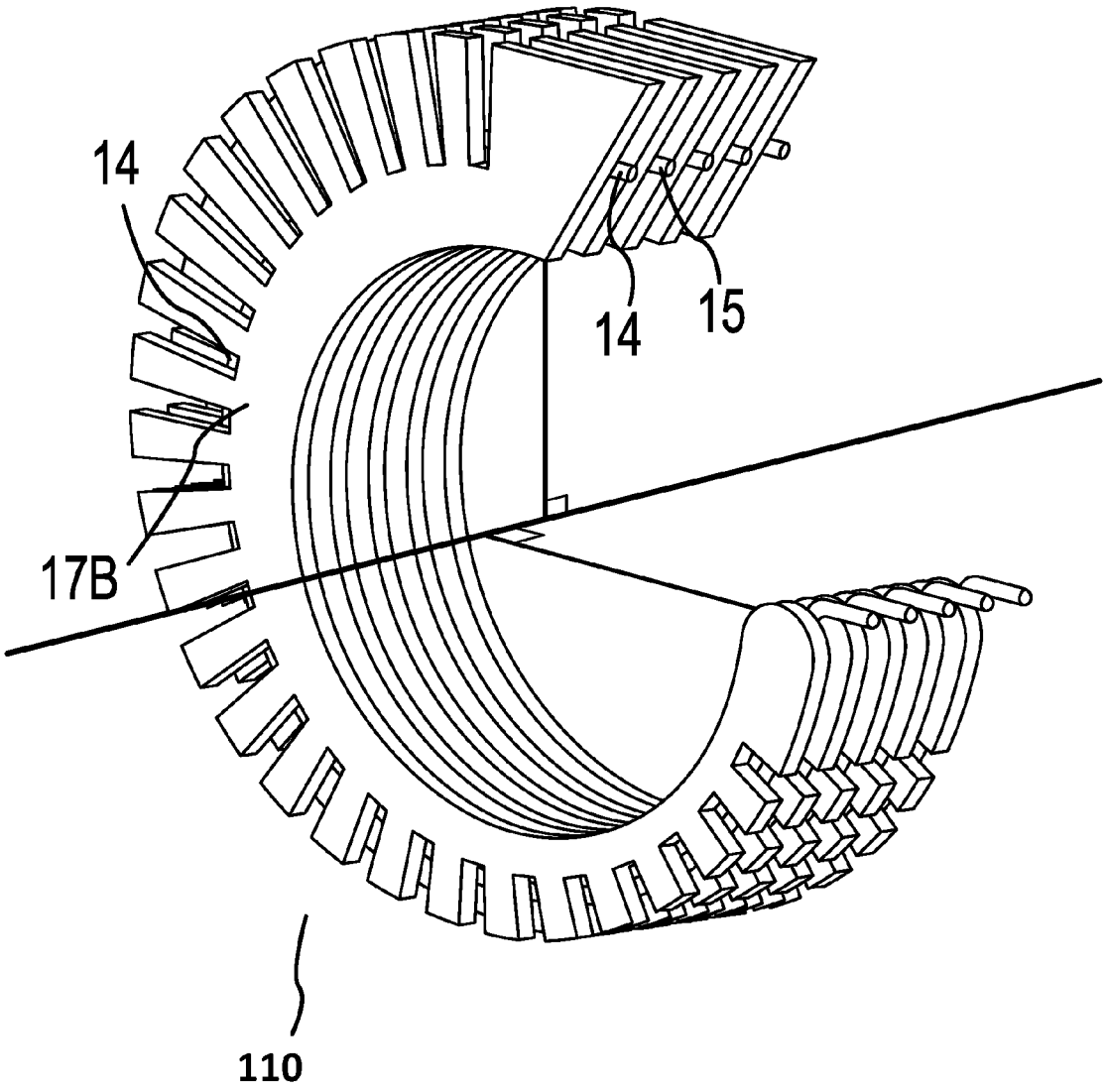
FIG. 25 is a detailed view of a portion of that which is illustrated in FIG. 23 illustrating a sectional auger fighting in accordance with various example embodiments of the present invention.

In further embodiments, the fins may extend into the path of the airflow, configured such that the fins are at least partially parallel with the air flow coming out of the fan wheel, and are spirally annular about an axis of the fan wheel, similar to an auger, wherein the axis of the fan wheel is partially perpendicular to the plane defined by the larger surface of the fins, e.g., the fins extend annularly about the axis of the fan wheel but also traverse a distance along the axis of the fan wheel, spiraling about the axis of the fan wheel. In various embodiments, one or more fin may thus be said to comprise sectional auger fighting 110 (see FIG. 25).

In various embodiments, the tubes may be biased toward the fin edge which is farthest from the centrifugal fan wheel. In various embodiments, the tubes may approach closer to the fin edge which is farthest from the centrifugal fan wheel at some points than at others. For instance, the fin edge which is farthest from the centrifugal fan wheel and the tubes may share a central axis, however, the fin edge may have non-constant radius whereas the tubes may have constant radius along the same arc length about the shared central axis of the fan wheel. In further embodiments, the fin edge may have a constant radius whereas the tubes may have non-constant radius along the same arc length about the shared central axis of the fan wheel.

In accordance with various embodiments, the one or more fins in the array may be perpendicular to and wrap around a portion of an axis of a centrifugal fan wheel. The fins and tubes form a non-contiguous outer wall of the centrifugal fan, for instance, wherein coining of the fin along the portion proximate to the tube causes the fin and tube to be in intermittent parallel contact. In various examples, the array may be manufactured by extruding the fins and tubes in a curved shape approximating a portion of the outer wall of the centrifugal fan.

In accordance with various embodiments of the present invention, the array may be configured such that the one or more fins occupy a space between an exterior of the centrifugal fan wheel and the centrifugal fan housing. In various embodiments, the fin may be dimensioned so that it does not substantially fill each space, for example, such as to allow space for other features, for instance, a recirculation scoop as discussed herein.

In accordance with various embodiments, the array may be incorporated into a refrigeration system as an evaporator. As shown in the attached FIGS. 1 through 24, the present invention provides a squirrel cage evaporator having a centrifugal fan wheel 12 with alternating refrigerant cooling coils (first tube 14 and second tube 15) encircling and comprising the outside diameter of the centrifugal fan wheel 12. The centrifugal fan wheel 12 includes an electric motor 13 having many mounting characteristics known in the art.

As shown in FIGS. 2, 20, 21 and 22A-B, fins 17A, 17B, 17C, and/or 17D divide each of the reversing flow refrigerant evaporator coils (e.g., first tube 14 and second tube 15). This configuration is such that fins 17A, 17B, 17C, and/or 17D separating the first tube 14 and the second tube 15 increases the service area of evaporator thereby allowing evaporator to be partially frozen in the direction of the refrigerant flow, which will defrost on a reverse cycle in every other tube as described in more detail below.

Figure 6:
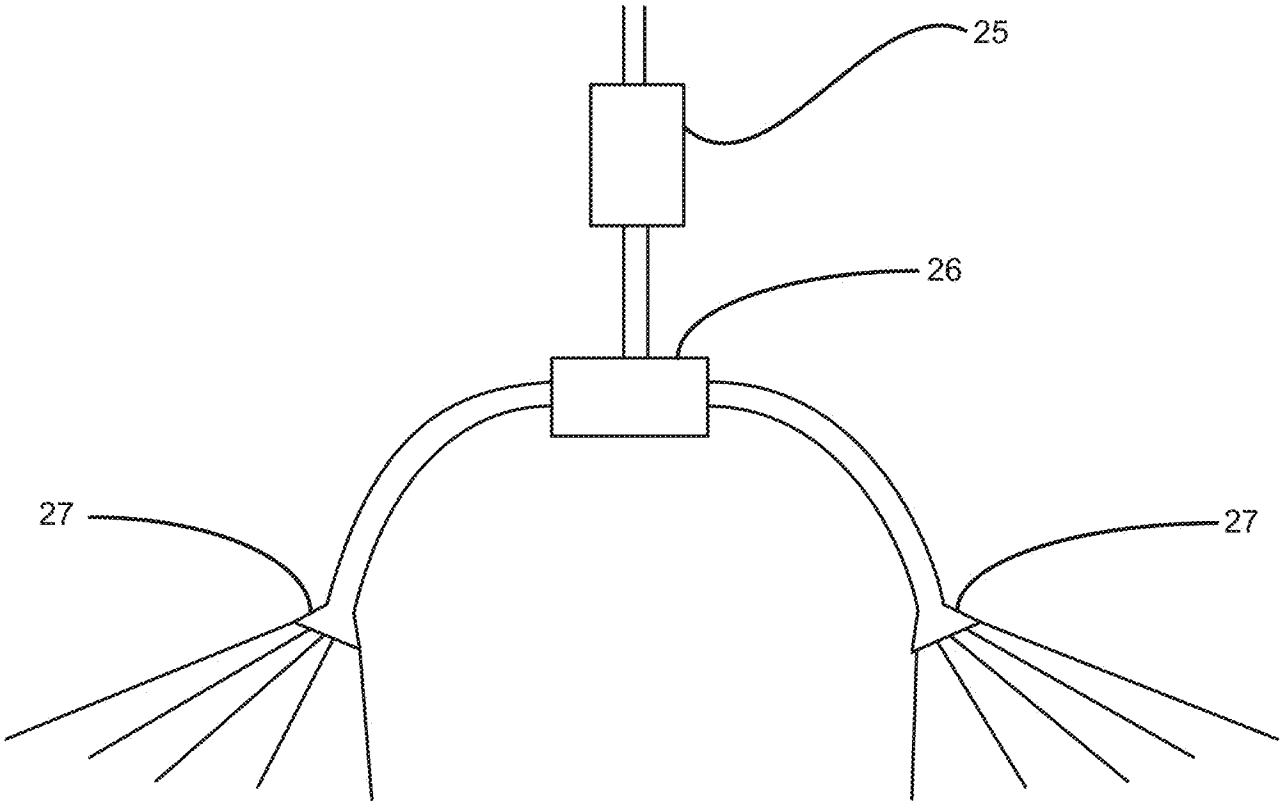
FIG. 6 is schematic drawing of a metering device reversing valve defuser tubing going to an evaporator in accordance with various example embodiments of the present invention.
Figure 7:
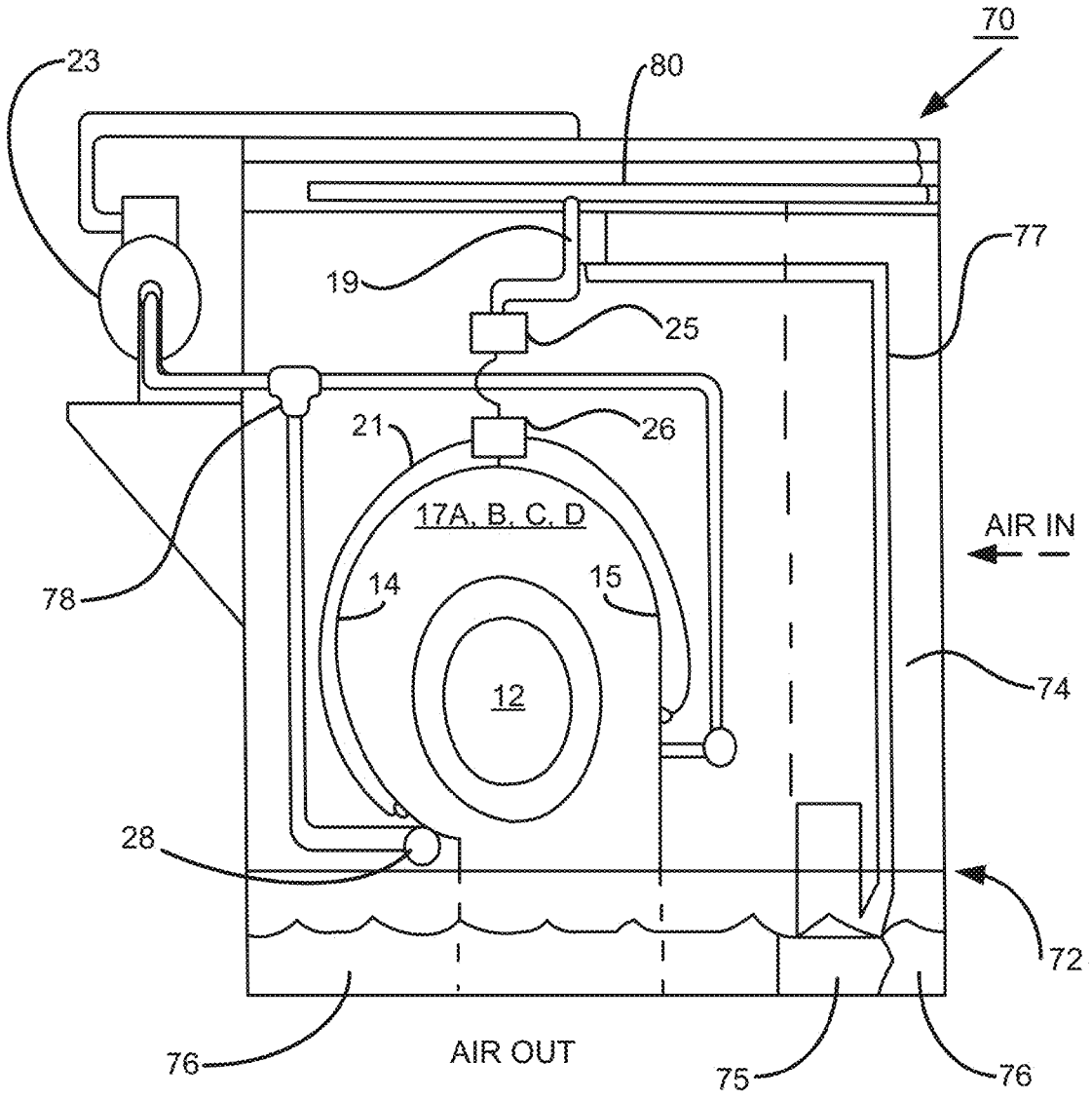
FIG. 7 is a side cross section view showing a squirrel cage evaporator positioned inside an evaporative cooler in accordance with various example embodiments of the present invention.

In accordance with various exemplary embodiments, as shown in FIGS. 6-7, a liquid line 19 leaves a condenser 80 having a filter-drier and sight glass all known in the art and supplying a metering device 25 at which point the liquid converts to a gas known in the art as "flashing". Liquid line 19 continues to a reversing valve 26 supplying flow in opposite directions through a plurality of diffusers 27 to supply each evaporator coil (first tube 14 and second tube 15) with its own supply of refrigerant.

In more detail, the squirrel cage evaporator, with its opposing flow of refrigerant, when applied to an evaporative cooler 70 known in the art, adds to the cooling capabilities of said evaporative cooler 70 by dehumidifying the air passing over partially freezing evaporative coils (first tube 14 and second tube 15). With evaporator coils (first tube 14 and second tube 15) freezing in alternating directions a frost pattern will alternate between one set of coils allowing the other set of coils not supplied to defrost. The condensing water, known in the art as condensate, moves along the radius forced by the velocity of the air to exit the fins 17A, 17B, 17C, and/or 17D and is directed via conduit 28 to a tank 76 of the evaporative cooler 70 thereby providing a large portion of the humidity as condensation to tank 76.

In a cooling embodiment, as air is blown over fins 17A, 17B, 17C, and/or 17D, heat is removed from evaporator coils (first tube 14 and second tube 15) via convective cooling. The present invention is suitable for use with many refrigerants, including but not limited to, R404 refrigerant which has an about −40° F. (about −40° C.) expansion point. When evaporator reaches the end of a pre-determined cycle of circulating refrigerant, ice starts to accumulate on the first tube 14, for example. Reversing valve 26 switches flow to second tube 15 thereby beginning to circulate refrigerant in the opposite direction of first tube 14. At the next end of the pre-determined cycle, reversing valve 26 switches flow direction again to provide refrigerant to first tube 14 again. By cycling the flow of refrigerant between evaporator coils (first tube 14 and second tube 15), the evaporator coils (first tube 14 and second tube 15) are allowed to thaw and therefore any accumulation of ice is prevented. This is an example of the switching flow described above.

Evaporator coils (first tube 14 and second tube 15) are parallel to one another and, preferably, made of metal though those skilled in the art will recognize that other materials may be suitable for use. In various metal embodiments, coils (first tube 14 and second tube 15) and fins 17A, 17B, 17C, and/or 17D are made of aluminum. Furthermore, fins and coils may comprise any suitable materials. In various embodiments, first tube 14 and second tube 15 are in contact with fins 17A, 17B, 17C, and/or 17D separating each first tube 14 from each adjoining tube comprising the second tube 15. In various embodiments, reversing valve 26 which is also known as a three way solenoid, is utilized to achieve the alternating flow.

Figure 8:
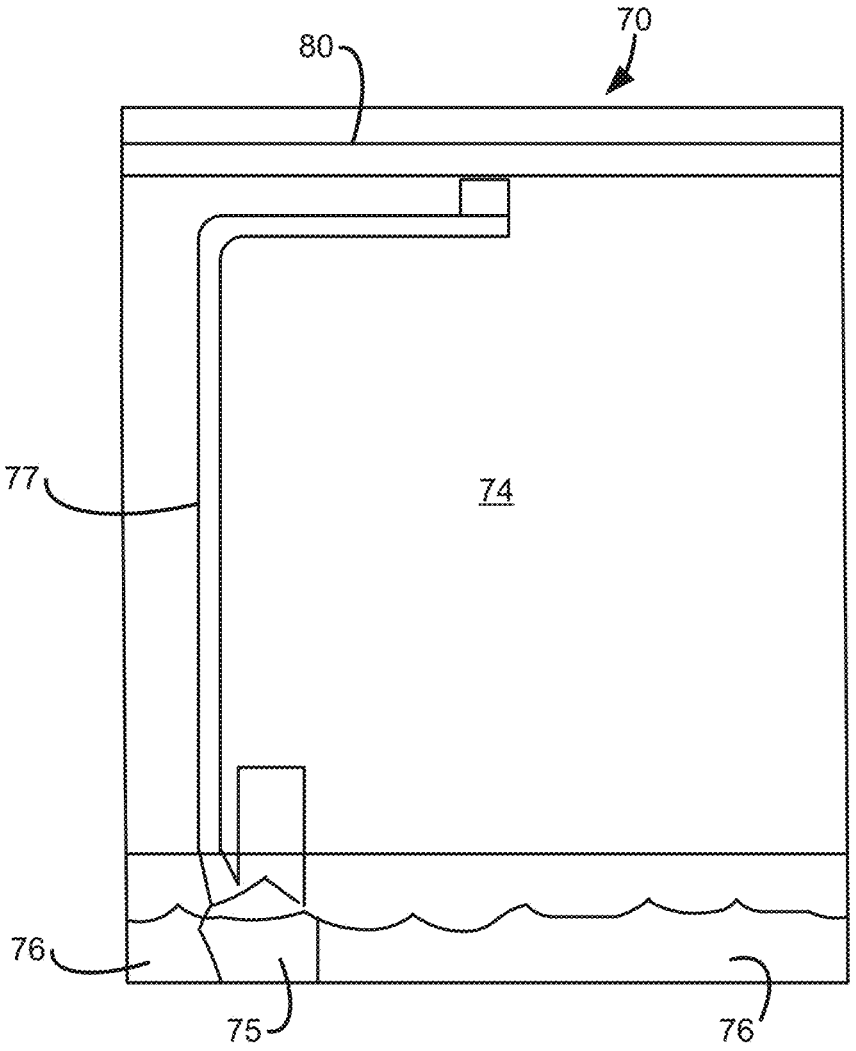
FIG. 8 is an end view of an evaporative cooler with air intake through evaporative pad also showing location of water pump and tubing to a water cooled condenser in accordance with various example embodiments of the present invention.
Figure 9:
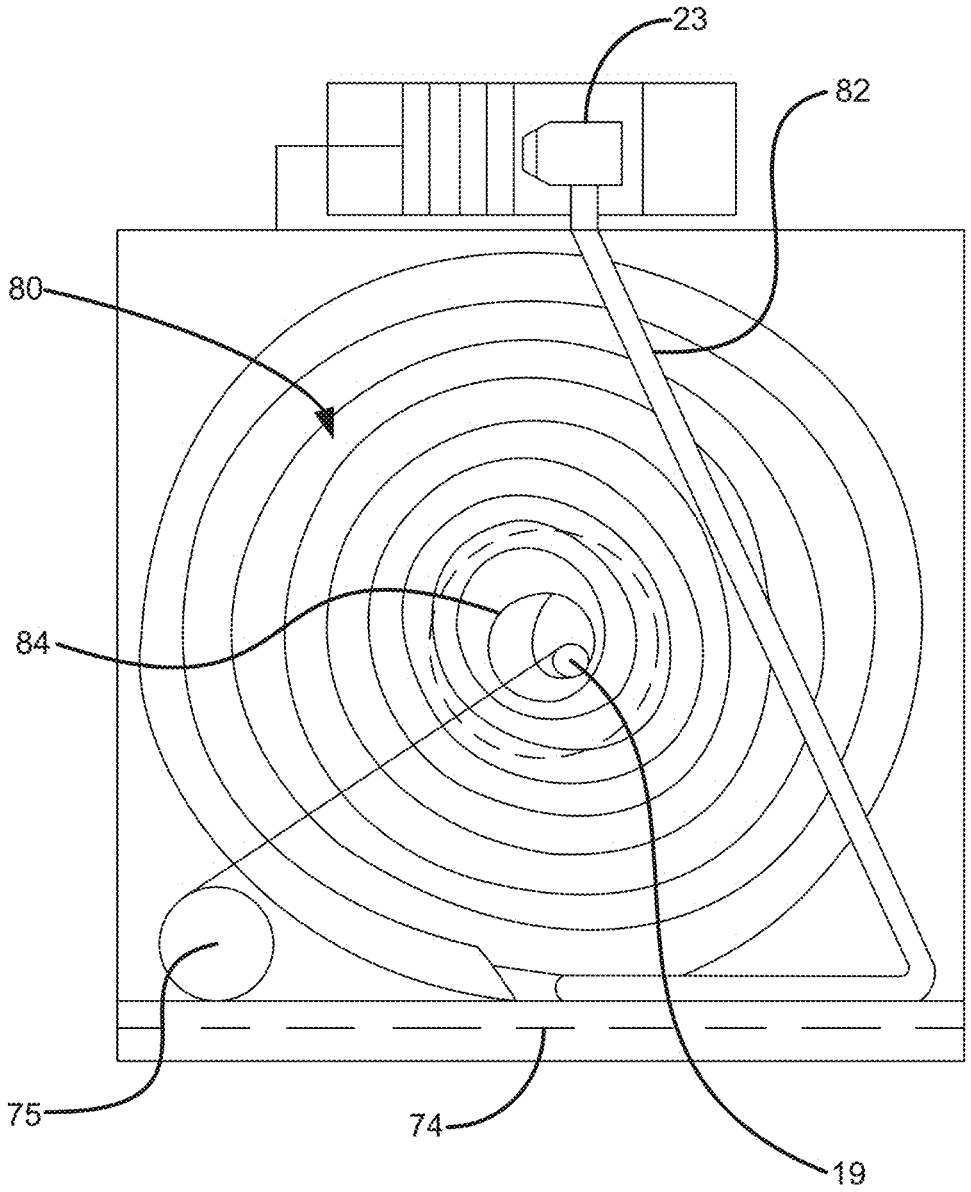
FIG. 9 is a view of the top with the scroll shaped water channel with condenser submerged in water, known in the art as water-cooled condenser, in accordance with various example embodiments.
Figure 10:
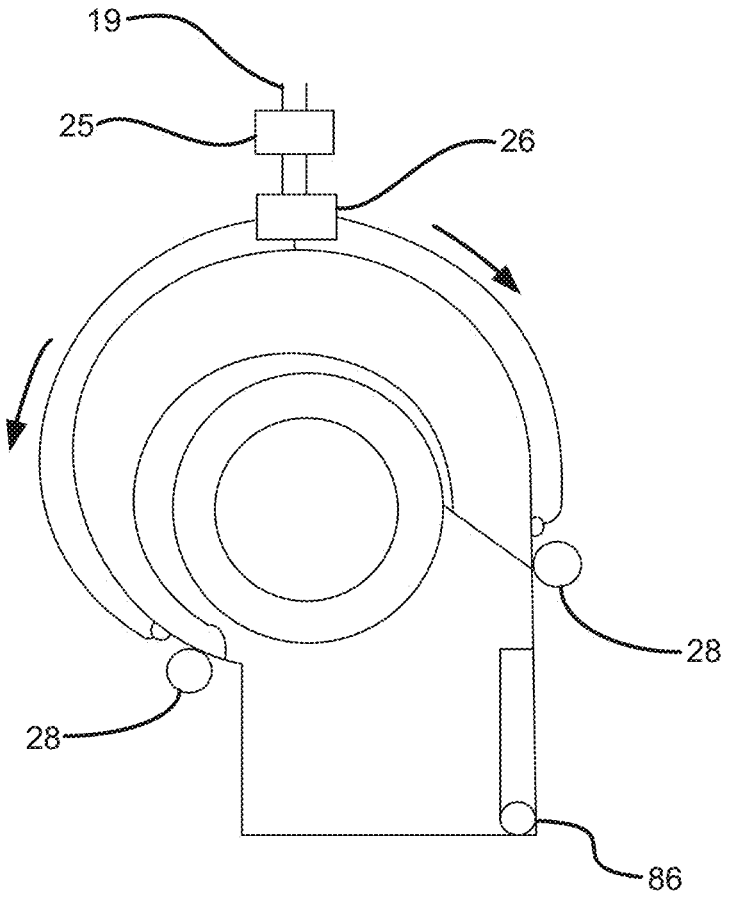
FIG. 10 is a close up view of a squirrel cage fan of FIG. 7, in accordance with various example embodiments of the present invention.
Figure 11:
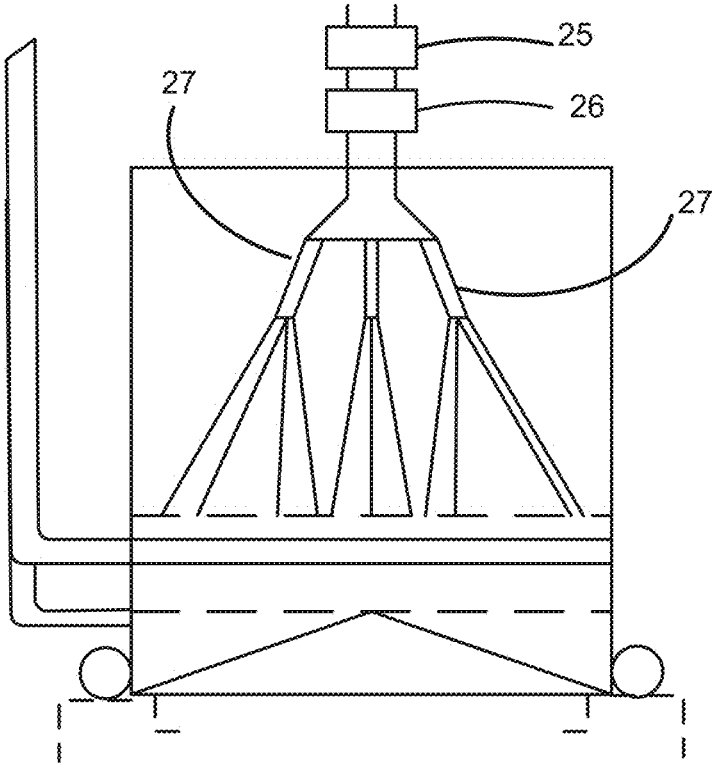
FIG. 11 is a schematic view of a metering valve, reversing valve and conduit of FIG. 7, in accordance with various example embodiments of the present invention.
Figure 12:
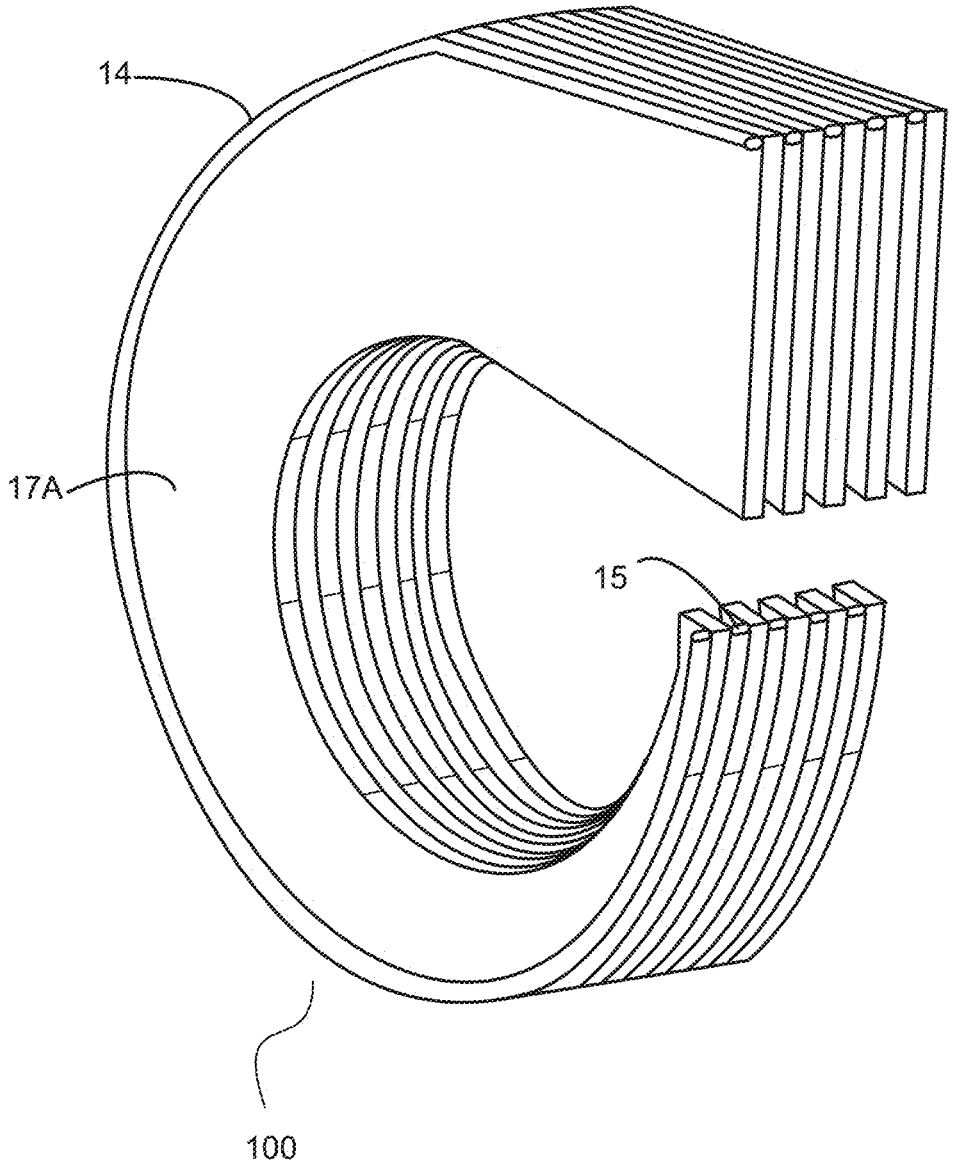
FIG. 12 is an isometric view of a fin and tube array in accordance with various example embodiments of the present invention.

Turning now to FIGS. 7-9, an evaporative cooler 70 is shown which employs various exemplary embodiments of the present invention. As shown, evaporative cooler 70 provides a box-like housing 72 (e.g., "first housing") having an evaporative pad 74 comprising one side (e.g., "a wall") thereof. Evaporative pad 74 is generally a wet cardboard material which allows air to pass therethrough. As the air passes therethrough, it evaporates some of the water in evaporative pad 74 and is thusly cooled. To keep evaporative pad 74 moist, the bottom of housing (evaporative cooler 70) forms a tank 76 which is filled with water, which is pumped by a water pump 75 through tubing 77 to the top of evaporative cooler 70 to flow down the evaporative pad 74.

Centrifugal fan wheel 12 (also called "squirrel cage fan 12") of the present invention may be mounted within housing 70 (also called "evaporative cooler 70"). The air output side of centrifugal fan wheel 12 extends downwardly through the bottom of housing (evaporative cooler 70). Centrifugal fan wheel 12, when operating, pulls air through evaporative pad 74 cooling and dehumidifying the air downwardly through the output side.

In various exemplary embodiments, and with reference to FIGS. 7 and 9, the suction side of evaporator coils (first tube 14 and second tube 15) are joined at fitting 78 and hence to the suction side of a compressor 23. From that point, compressor 23 condenses the refrigerant and sends it through an inlet 82 to condenser 80 mounted on top of housing (evaporative cooler 70) in liquid line 19. In the preferred embodiment, as best seen in FIG. 9, condenser 80 is in the shape of a spiral with an inlet 82 on the outer edge of the spiral down liquid line 19 from the center of the spiral positioned just above centrifugal fan wheel 12.

In various exemplary embodiments, condensed water from the coils will drip into tank 76 thereby providing indeterminate amount of "calcium free" water to the reservoir at the bottom of the evaporative cooler providing for a cleaner environment and longer life set of filter pads. In another exemplary embodiment, tubing 77 from a water pump 75 pumps reservoir water into the middle of the spiral of condenser 80. The water runs along condenser 80 opposite the refrigerant flow in liquid line 19 thereby providing further cooling of the refrigerant contained therein before encountering the evaporative pad 74 where it drops down the front of evaporative pad 74 for cooling purposes.

Figure 13:
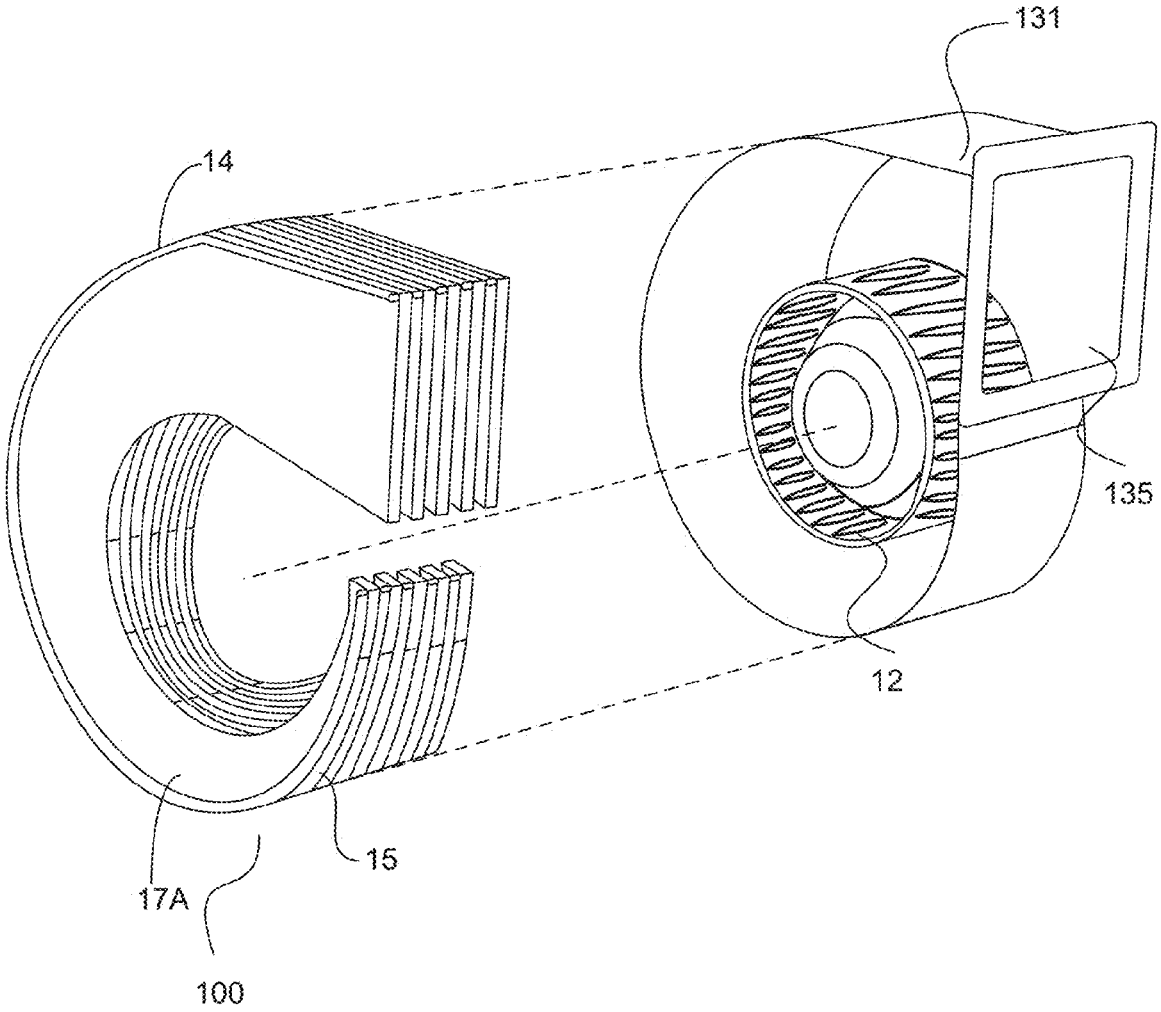
FIG. 13 is a partially exploded isometric view of a fin and tube array and an open centrifugal fan in accordance with various example embodiments of the present invention.
Figure 14:
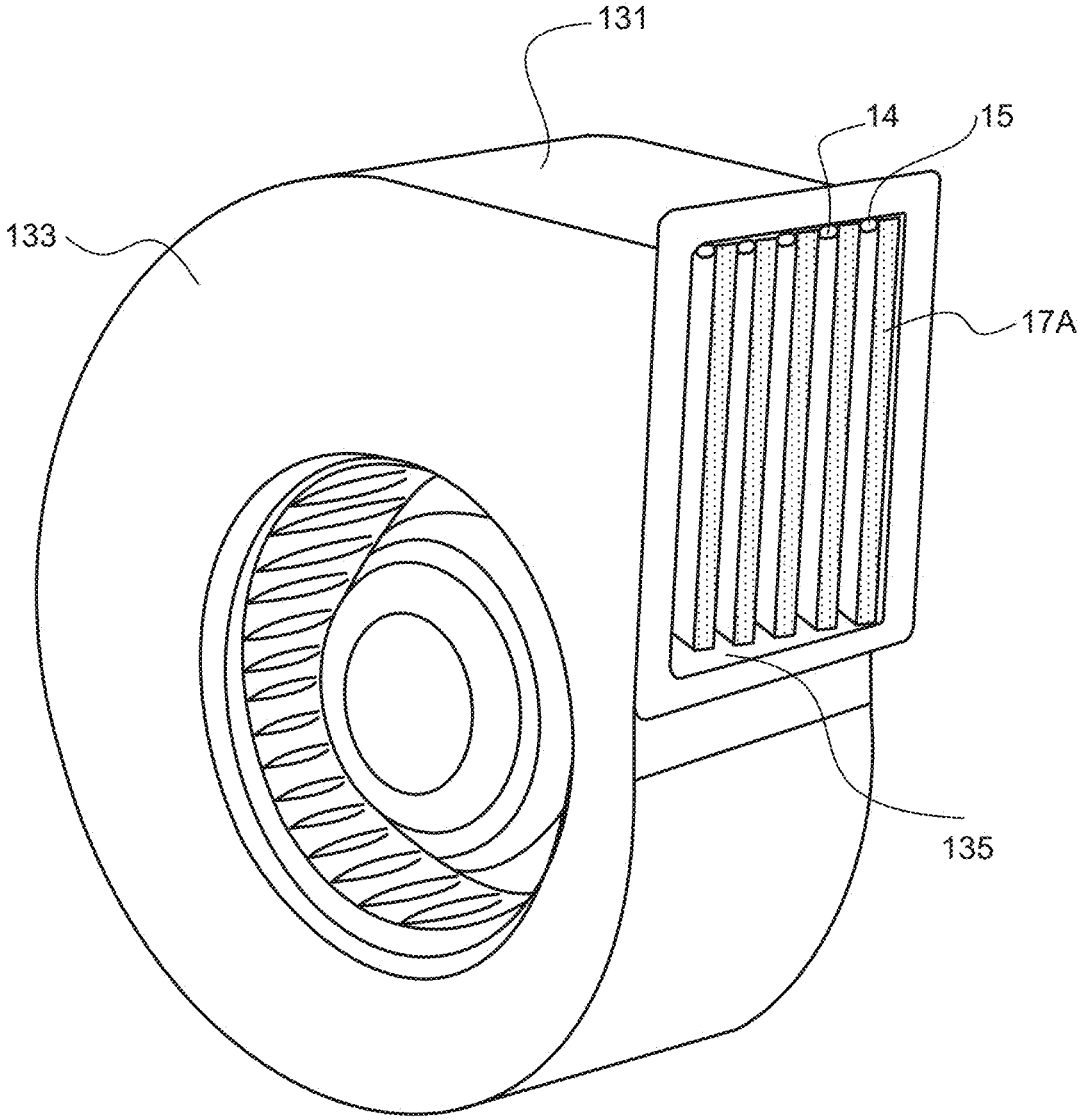
FIG. 14 is an isometric view a centrifugal fan with a fin array on the interior in accordance with various example embodiments of the present invention.
Figure 24:
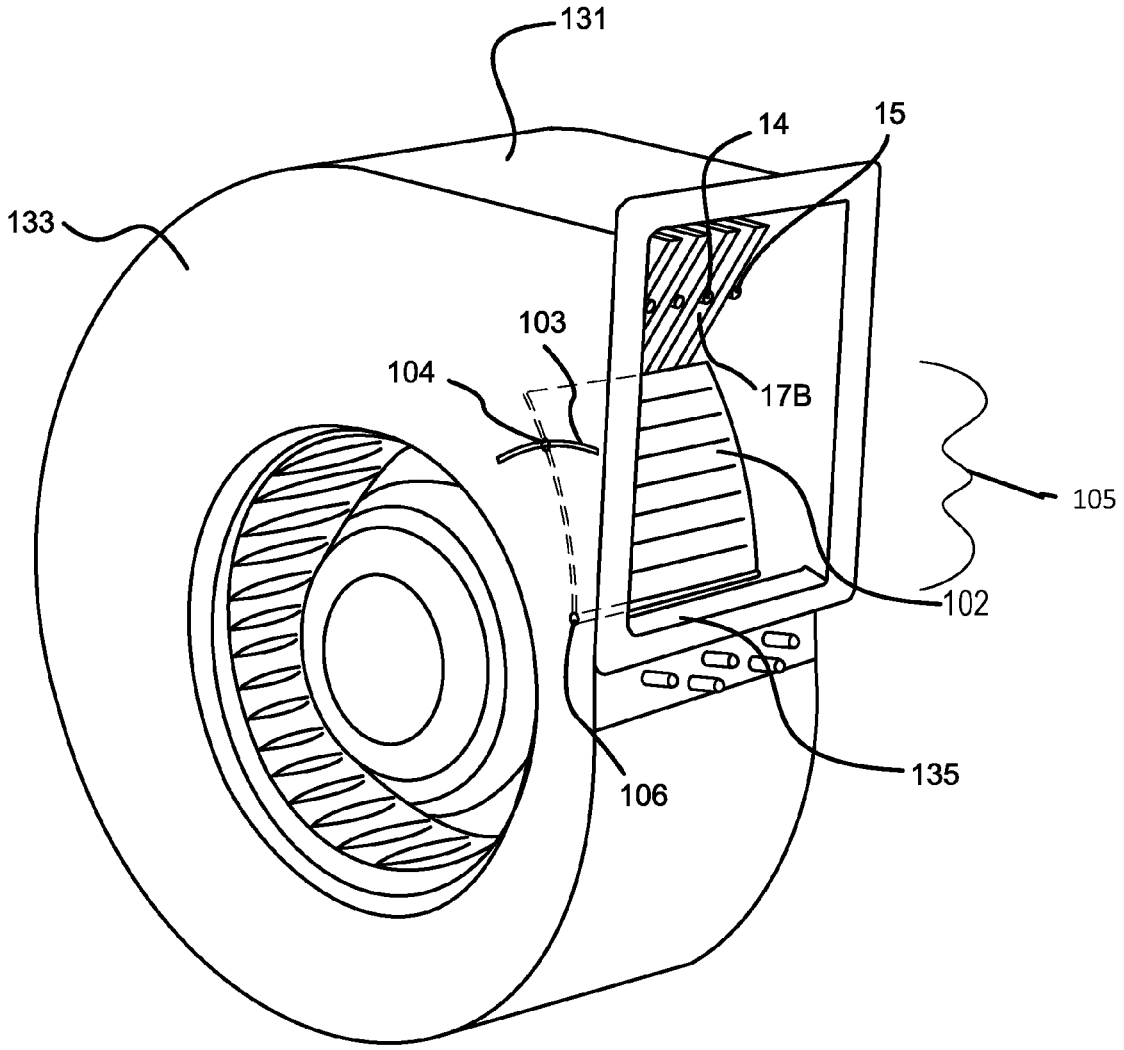
FIG. 24 is an isometric view a centrifugal fan with a fin array with a slotted fin apparatus on the interior in accordance with various example embodiments of the present invention.

In accordance with various embodiments of the invention, and illustrated in FIGS. 1, 12, 13, 19A-B, 22A-B, and 23, tube/fin array 100 may be configured as a single assembly comprising one or more fins 17A, 17B, 17C, and/or 17D, contacting the first tube 14 and the second tube 15. The profile of the fins and tubes may be exaggerated in the figures e.g. FIGS. 12 and 13. The fins may be any width/thickness suitable to transfer energy between tubes 14/15 and the air passing through the fins. A plurality of tubes and fins may be included in the array functioning similarly to fin 17A, 17B, 17C, and/or 17D, first tube 14, and second tube 15 as discussed herein. In accordance with various embodiments of the invention, and as illustrated in FIG. 13, tube/fin array 100 may be inserted into the interior of the centrifugal fan. While FIG. 13 is shown with the centrifugal fan having outside surface 131, the system may be operated without the centrifugal fan having an outside surface. Instead, the outside surface of tube/fin array 100 may function as the outside surface of the centrifugal fan. In either configuration, tube/fin array 100 may be located around centrifugal fan wheel 12 allowing air to be forced from centrifugal fan wheel 12 into the fins 17A, 17B, 17C, and/or 17D along first tube 14 and second tube 15 and out of the centrifugal fan outlet 135. As illustrated in FIGS. 14 and 24, the centrifugal fan may be enclosed or partially enclosed, with tube/fin array 100 being located on the interior of the centrifugal fan shell. First tube 14 and second tube 15 and fins 17A, 17B, 17C, and/or 17D may be shown through the centrifugal fan outlet 135.

Figure 15:
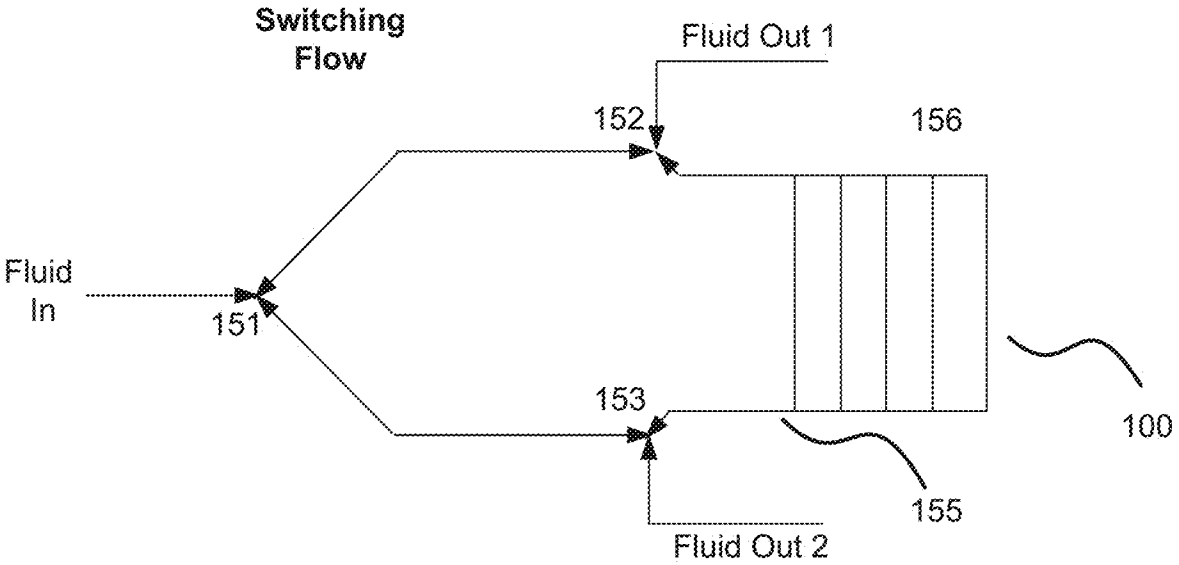
FIG. 15 is an exemplary diagram of a switching fluid flow through a tube array in accordance with various example embodiments of the present invention.

In accordance with various embodiments of the invention, and illustrated in FIG. 15, tube/fin array 100 may be plumbed with a switching flow. In various examples, tube/fin array 100 may be connected to valves 152 and 153 on each of the first end 156 and the second end 155 of tube/fin array 100. Valves 152 and 153 may be connected to valve 151. Valves 152 and 153 may also exit fluid away from the array. In one instance, fluid may enter the valve 151. Valve 151 may be configured to direct the fluid to either valve 152 or valve 153. If directed to valve 152, the fluid enters valve 152 and is directed into first end 156 of tube/fin array 100 and then out the second end 155 of tube/fin array 100. The fluid then proceeds to valve 153 which may direct the fluid away from tube/fin array 100 to fluid out 2. In a second instance, the system may be switched such that the fluid flows through the array in the other direction. For example, valve 151 may direct fluid to valve 153. Valve 153 may direct fluid into second end 155 of tube/fin array 100. The fluid may exit the tube/fin array 100 at first end 156 and proceed to valve 152. Valve 152 may then direct fluid away from tube/fin array 100 to fluid out 1. While this is only a few examples of switching flow, all systems for providing switching flow available to a person of ordinary skill in the art are contemplated herein.

Figure 16:
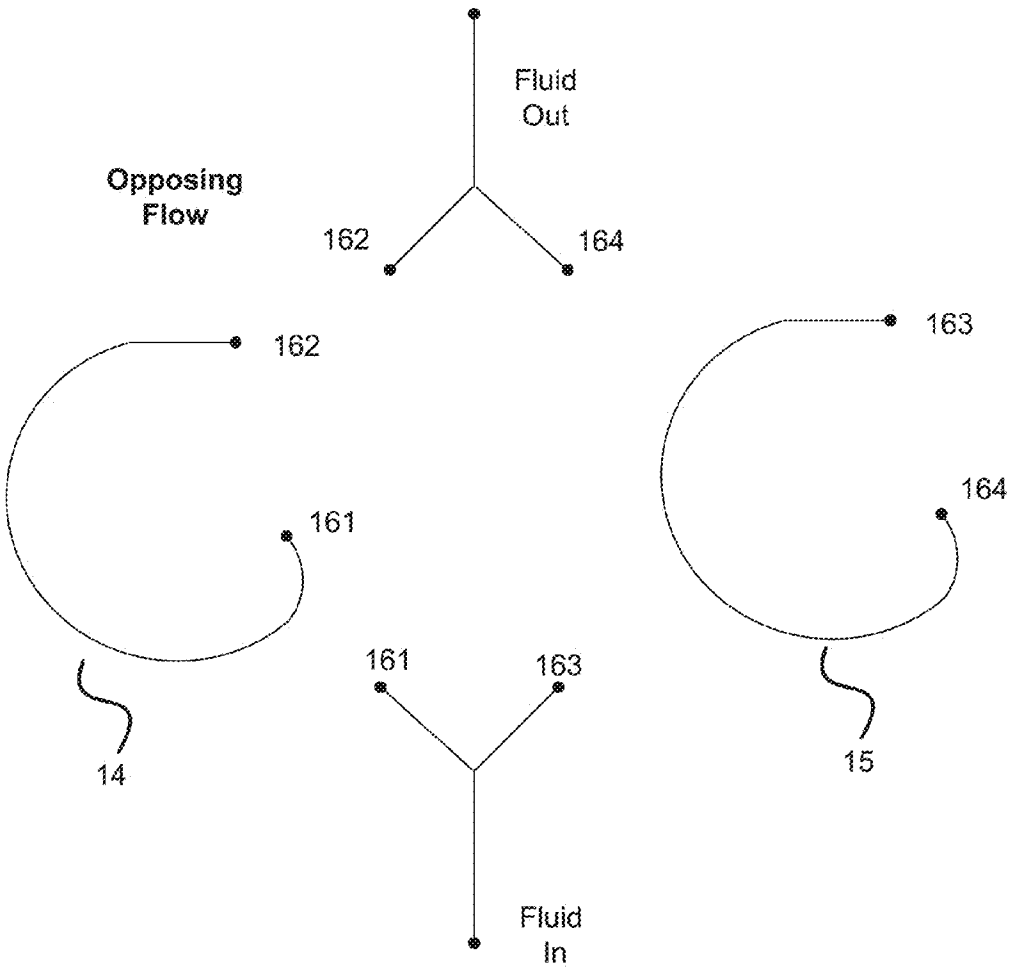
FIG. 16 is an exemplary diagram of an opposing fluid flow through a tube array in accordance with various example embodiments of the present invention.

In accordance with various embodiments of the invention, and illustrated in FIG. 16, tube/fin array 100 may be plumbed with an opposing flow. In various examples, first tube 14 of tube/fin array 100 may be connected at a first end 162 to a fluid outlet. First tube 14 may be connected at a second end 161 to a fluid inlet. Second tube 15 of tube/fin array 100 may be connected at a first end 163 to a fluid inlet. Second tube 15 may be connected at a second end 164 to fluid outlet. In this configuration fluid flowing through first tube 14 flows in the opposite direction of fluid flowing through the second tube 15. While this is only a few examples of opposing flow, all systems for providing opposing flow available to a person of ordinary skill in the art are contemplated herein.

Figure 17:
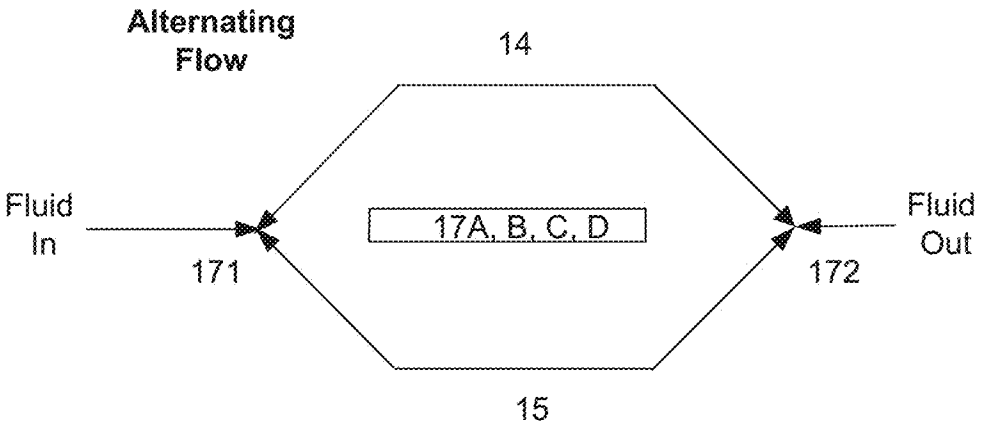
FIG. 17 is an exemplary diagram of an alternating fluid flow through a fin array in accordance with various example embodiments of the present invention.

In accordance with various embodiments of the invention, and illustrated in FIG. 17, tube/fin array 100 may be plumbed with an alternating flow. In various examples, first tube 14 of tube/fin array 100 may be connected at a first end to valve 171. First tube 14 may be connected at a second end to valve 172. Second tube 15 may be connected at a first end to valve 171. Second tube 15 may be connected at a first end to valve 172. In this configuration, fluid may enter the valve 171 and be directed to either first tube 14 or second tube 15. In one instance, the fluid is directed to first tube 14 by valve 171. The fluid may exit the first tube 14 at valve 172 and be directed to the fluid outlet. In a second instance, the fluid may be directed from "fluid in" to the second tube 15 by valve 171. The fluid may exit the second tube 15 at valve 172 and be directed to the fluid outlet. In this configuration, fluid may alternate between two tubes. While this is only a few examples of alternating flow, all systems for providing alternating flow available to a person of ordinary skill in the art are contemplated herein.

Figure 18:
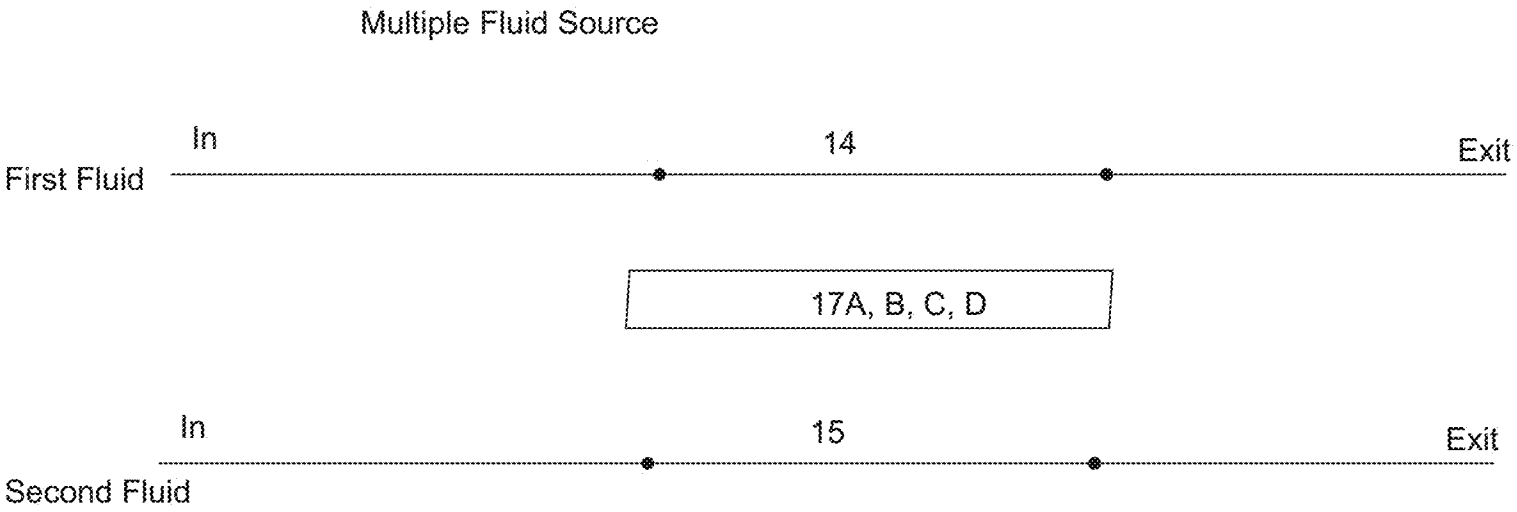
FIG. 18 is an exemplary diagram of a multiple fluid source fluid flow through a fin array in accordance with various example embodiments of the present invention.

In accordance with various embodiments of the invention, and illustrated in FIG. 18, tube/fin array 100 may be plumbed with multiple fluids. For example, a first fluid source may be connected to first tube 14. The fluid may enter the first tube 14 on a first end and exit on a second end. Similarly, a second fluid source may be connected to the second tube 15. In this configuration, a tube array may run multiple fluids. The fluid may enter the second tube 15 on a first end and exit on a second end. While this is only a few examples of multiple fluids, all systems for providing multiple fluids available to a person of ordinary skill in the art are contemplated herein.

As discussed herein, the fin and tube array may be configured to operate in accordance with one or more of an alternating flow, an opposing flow, and a switching flow. As there are numerous combinations of these three configurations multiplied by various implementations of each, all possible combinations are not discussed and illustrated herein. Suffice it to say that based on the drawings and description provided herein, one of ordinary skill in the art can implement the various combinations and implementations.

In accordance with various embodiments of the invention, and illustrated in FIGS. 19A-B, 22A-B, and 23, tube/fin array 100 may be configured as a single assembly comprising one or more fins 17B, contacting the first tube 14 and the second tube 15. In various embodiments, each fin 17B may comprise a slotted fin apparatus 200. A slotted fin apparatus 200 may comprise an arrangement of cutouts 202 from the fin 17B (e.g., "fin slots") whereby a gap 203 between the fin 17B and the tube (first tube 14 and second tube 15) is formed. For instance, in various embodiments, an alternating series of cutouts 202 and extensions 201 may be disposed around at least a portion of the perimeter of the fin 17B. with momentary reference to FIG. 22B, the slotted fin apparatus 200 may comprise offset slots, for instance, the alternating series of cutouts 202 and extensions 201 may be offset from one fin 17B to another, adjacent fin 17B, so that the cutouts 202 do not align in coincident circumferential positions.

Referring again to FIGS. 19A-B, 22A-B, and 23, for example, a tube/fin array 100 may have a first tube and a second tube. There may be a fin having a first end and a second end and including a slotted fin apparatus 200. The slotted fin apparatus may have a first extension and a second extension disposed along the at least a portion of the length of the fin and a first cutout disposed between the first extension and the second extension along the at least a portion of the length of the fin wherein the first cutout is defined through the fin and bounded by the first extension and the second extension. The first tube and the second tube may be in parallel contact with the fin along at least a portion of the first extension. The fin may be sandwiched between the first tube and the second tube. The fin, first tube, and the second tube may be substantially annular about an axis of the fan wheel.

The first tube and the second tube may be biased toward an edge of the fin farthest from the centrifugal fan wheel. The first tube and the second tube may be biased to any position radially outward of the axis of the fan wheel. For instance, the first tube and the second tube may be generally halfway between the edge of the fin nearest to the centrifugal fan wheel and the edge of the fin farthest from the centrifugal fan wheel. In further embodiments, the first tube and the second tube may be about two-thirds farther from the edge of the fin nearest to the centrifugal fan wheel than to the edge of the fin farthest from the centrifugal fan wheel. In further embodiments, the first tube and the second tube may be about three-quarters farther from the edge of the fin nearest to the centrifugal fan wheel than to the edge of the fin farthest from the centrifugal fan wheel.

The gap 203 may be bounded as follows. For example, the first cutout may be further bounded by a cutout floor line 205 comprising an inward boundary of the cutout and the gap may be a first gap comprising an aperture defined by the cutout floor line, the first extension, the second extension, and least one of the first tube and the second tube, whereby the aperture is configured to permit condensate to exit the fin array. For instance, gap 203 may provide a path around the first tube and/or the second tube to allow air and/or condensate to escape from the region radially inward of the first tube and the second tube.

For instance, air may travel along a fluid path 206 from region A to region B. Region A may be radially inward of the first tube and the second tube and region B may be radially outward of the first tube and the second tube. Fluid path 206 may extend radially outward past the first tube and/or the second tube and through the gap 203. In this manner, condensate may escape from within region A and may drain from the tube/fin array 100 via a drain port 209 connected to or part of region B. Moreover, the interaction of air from region A to/from region B, may improve the heat transfer efficiency of the structure. Also, the slotted fin apparatus 200 may create local fluid flow interruptions whereby fluid is impelled to more vigorously contact, or to contact for longer duration, or for more molecules of the fluid to contact, the fins, whereby heat transfer may be improved. Thus, the fins may be configured to disrupt the laminar air flow in the centrifugal fan assembly. This is in contrast to typical centrifugal fans that attempt with highest efficiency to expel the air as quickly and smoothly as possible. Here however, the efficiency of the air flow is exchanged to increase the efficiency of transferring heat from the fins to the air.

In various embodiments, each cutout 202 comprises a trapezoidal aperture extending radially inward from the outer peripheral circumference of the fin 17B, for instance, the edge proximate to the outside surface 131 and toward the inner edge of the fin 17B, such as the edge proximate to the fan 16. In various embodiments, the cutout 202 extends radially inwardly to an innermost bound comprising a cutout floor line 205. A cutout floor line 205 may comprise an inward boundary of the cutouts 202. The cutout floor line 205 may comprise a line having a non-constant radius about the center of the tube/fin array 100 and/or centrifugal fan wheel 12. In further embodiments, the cutout floor line 205 may comprise an inward boundary of the cutouts 202 comprising a line having a constant radius about the center of the tube/fin array 100 and/or centrifugal fan wheel 12. In various embodiments, the cutout floor line 205 having a non-constant radius may thus be oriented so that cutouts 202 (and thus extensions 201) proximate to the centrifugal fan outlet 135 may be deeper (e.g., less shallow), having a first depth 204-1 and those circumferentially farther from the centrifugal fan outlet 135 may be shallower (e.g., less deep), having a second depth 204-2 lesser than the first depth 204-1. Those cutouts 202 interstitially positioned between these two ends may have gradually progressing depths less than the first depth 204-1 and greater than the second depth 204-2. In this manner, a gap 203 may be maintained between the fin 17B and first tube 14 and second tube 15, wherein the gap 203 has constant spacing (e.g., aperture size) and wherein the tube has a non-constant radius and/or follows a different arc than the outer edge of the fin 17B. In various embodiments, each cutout 202 may comprise a triangular aperture, or a complex curvature, or an oval aperture, or any shape as desired.

Gap 203 may have any shape or dimension whereby condensate may be drainable from the tube/fin array 100. In various embodiments, wherein a plurality of gaps 203 are contemplated, various of the gaps 203 may have similar size and/or dimension, and various of the gaps 203 may have dissimilar size and/or dimension, as may be desired to achieve various flow characteristics, such as speed, pressure, or volume, and yet permit condensate to be drainable from the tube/fin array 100 at a rate sufficient in view of the rate of condensate accumulation. At various points, condensate may accumulate at various rates, thus making dissimilar sizing of gaps 203 desirable.

In various embodiments, each extension 201 may comprise a section of fin 17B disposed between two such of the cutouts 202. In various embodiments, each cutout 202 may be disposed between two such of the extensions 201. Each extension may comprise a portion of a fin 17B extending outwardly from the cutout floor line 205 to proximate to the outside surface 131. In various embodiments, each extension 201 is similar in size and shape to at least one adjacent cutout 202. In further embodiments, each extension 201 has a differing shape and/or size from at least one adjacent cutout 202. In various embodiments, each extension 201 may comprise a triangular portion, or a complex curvature, or an oval portion, or any shape as desired.

Figure 19A:
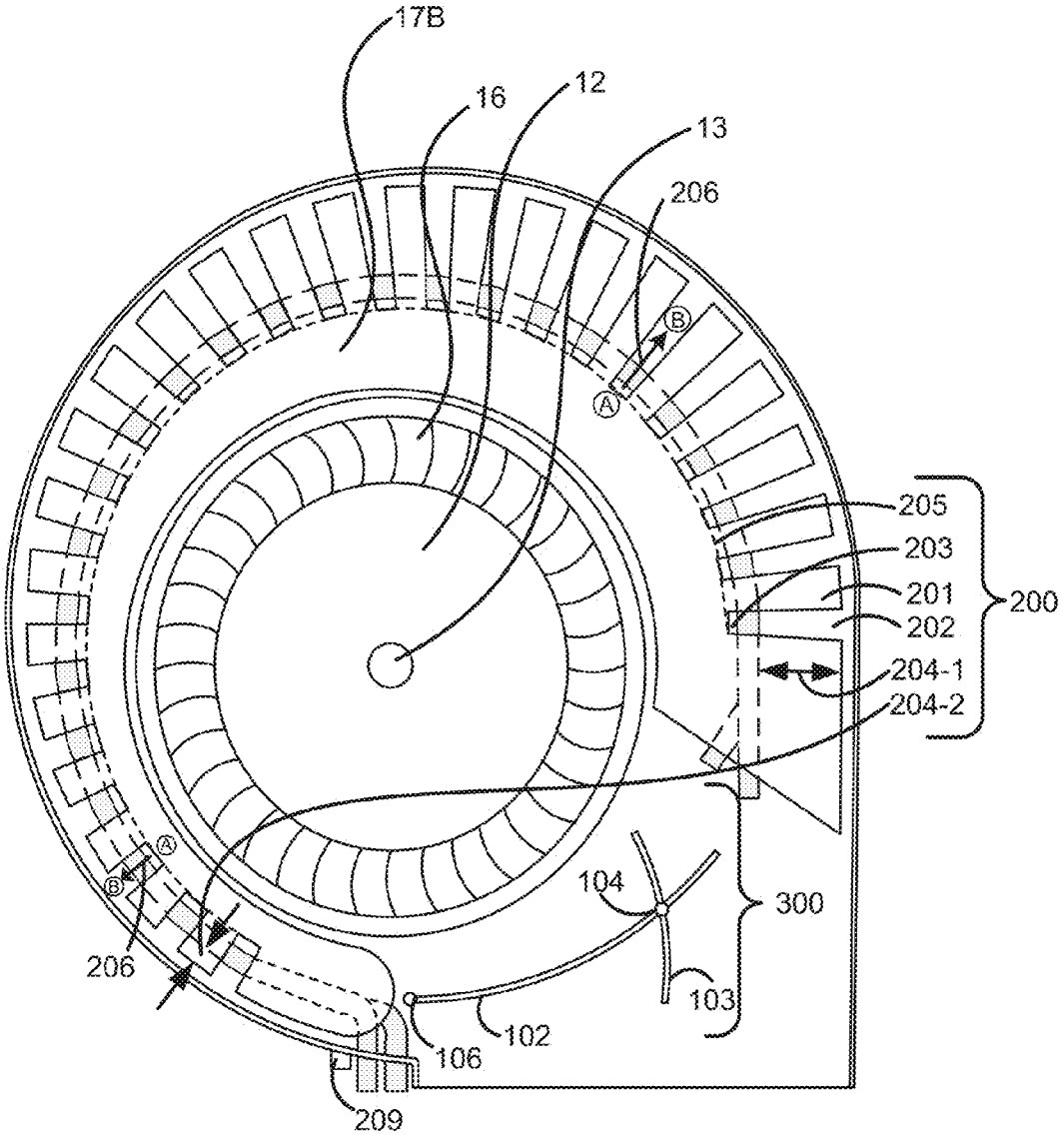
FIG. 19A is an open end view of a squirrel cage fan evaporator having a slotted fin apparatus, in accordance with various example embodiments of the present invention.
Figure 19B:
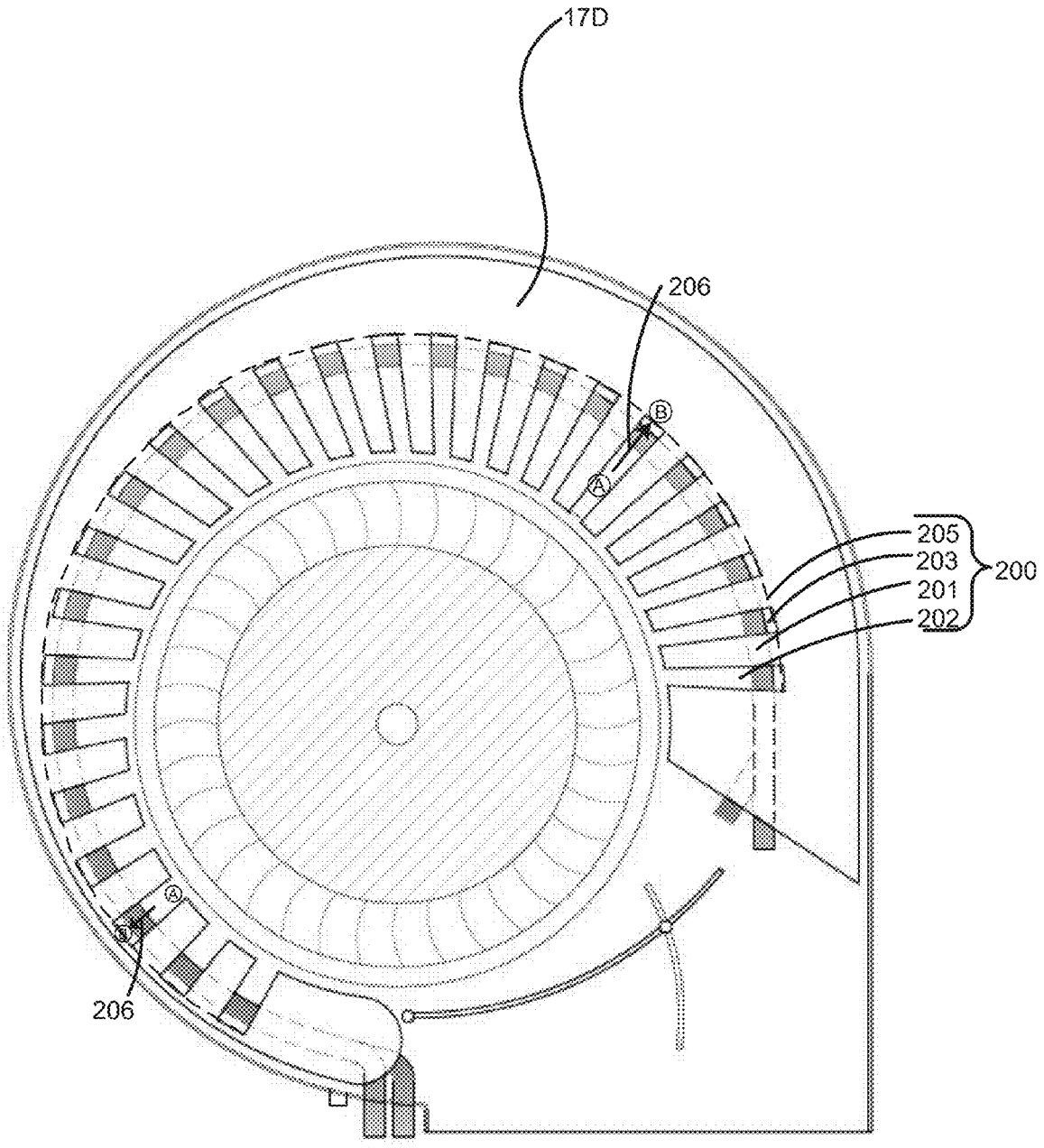
FIG. 19B is an open end view of a squirrel cage fan evaporator having an inverted slotted fin apparatus, in accordance with various example embodiments of the present invention.
Figure 20:
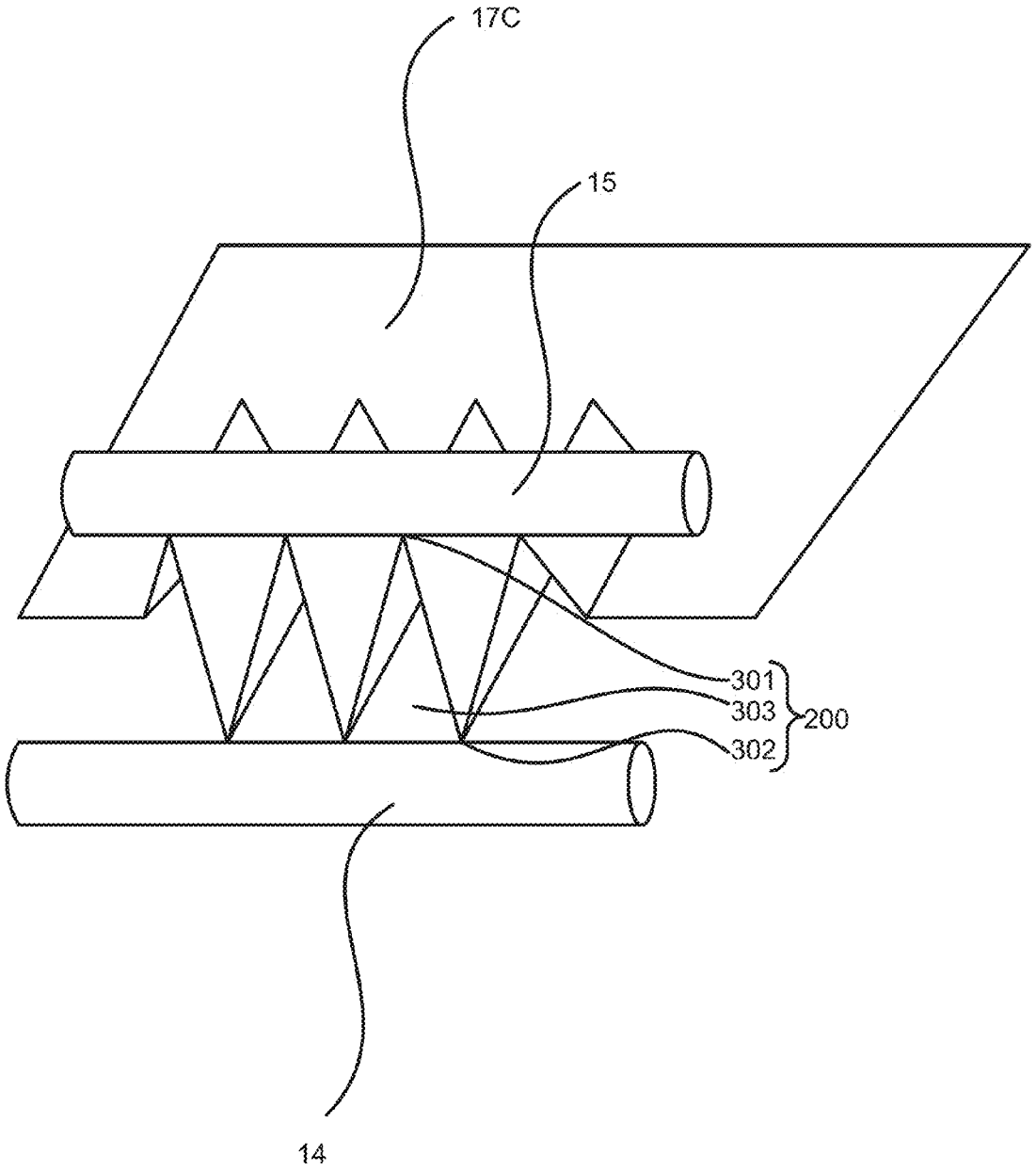
FIG. 20 is an view of fin and tube of a fin array having coining, in accordance with various example embodiments of the present invention.
Figure 21:
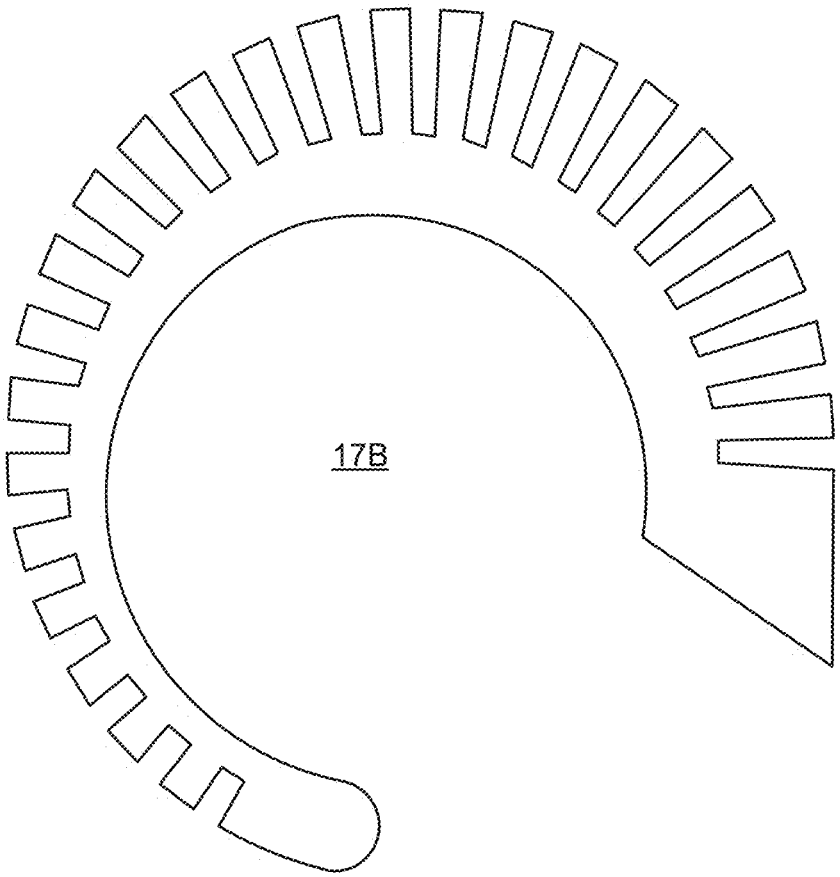
FIG. 21 is a view of one of several cooling fins used in the present invention depicted in FIG. 19A having a slotted fin apparatus, in accordance with various example embodiments of the present invention.
Figure 22A:
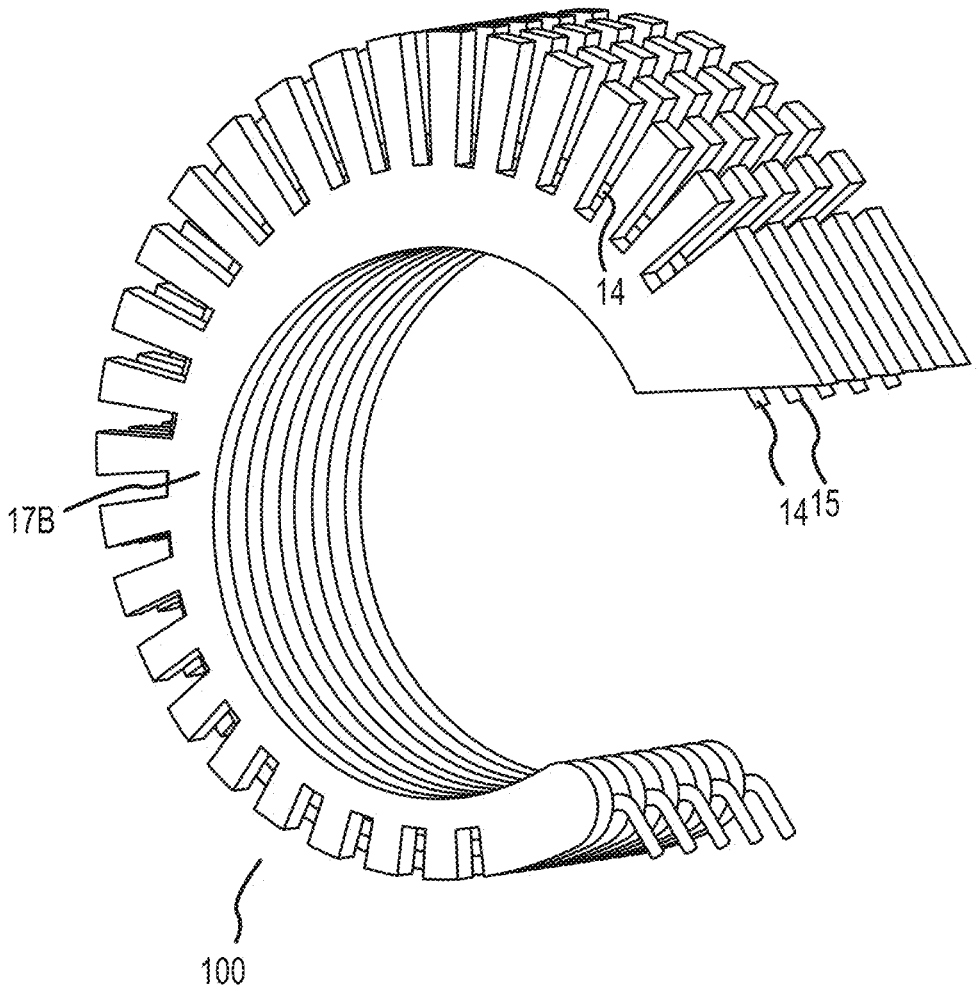
FIG. 22A is an isometric view of a fin and tube array having fins with a slotted fin apparatus in accordance with various example embodiments of the present invention.
Figure 22B:
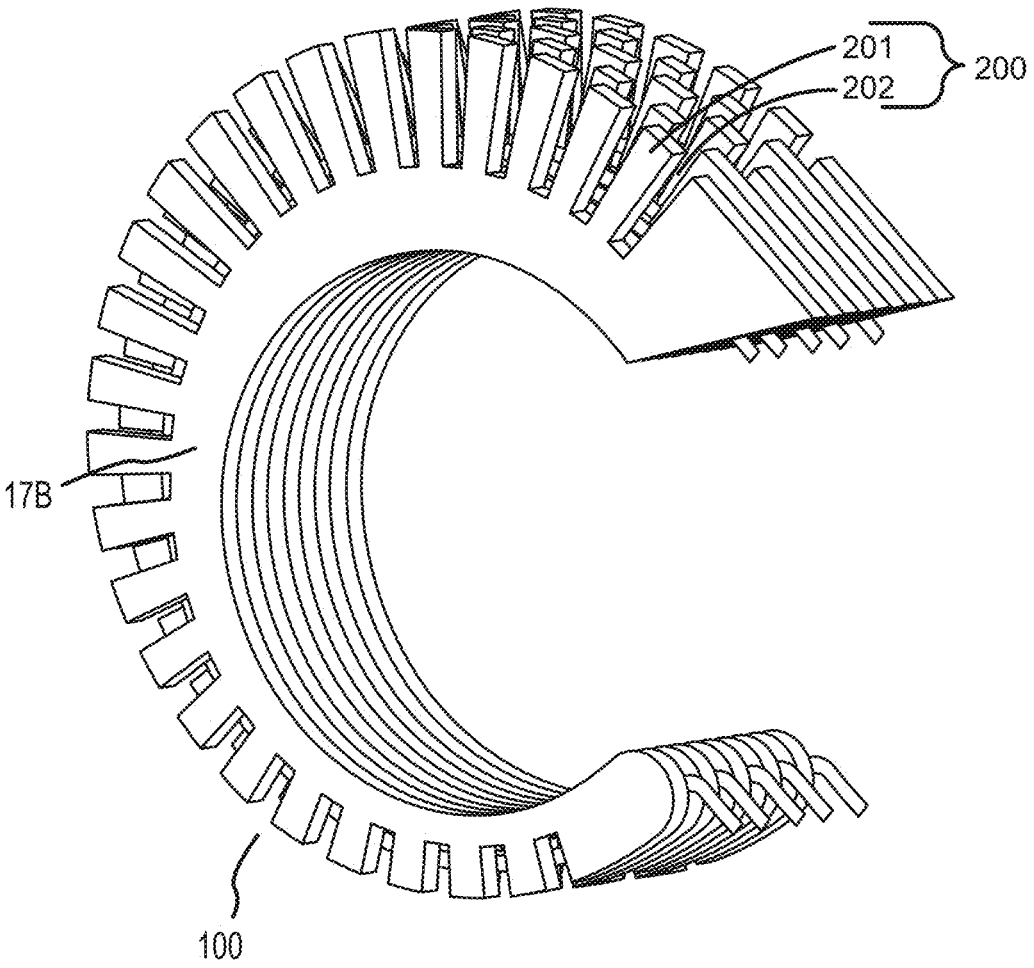
FIG. 22B is an isometric view of a fin and tube array having fins with a slotted fin apparatus with offset slots in accordance with various example embodiments of the present invention.
Figure 23:
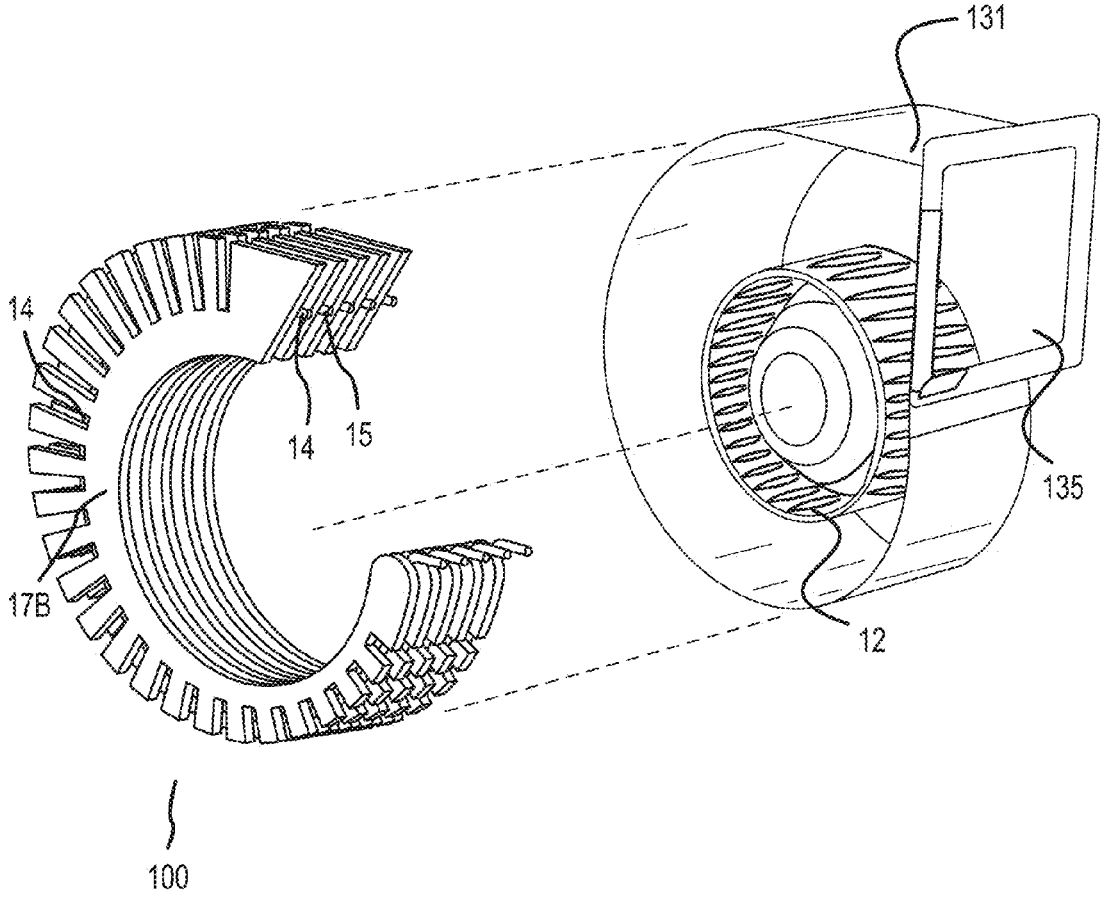
FIG. 23 is a partially exploded isometric view of a fin and tube array and an open centrifugal fan having a slotted fin apparatus in accordance with various example embodiments of the present invention.

With reference to FIG. 19B and fins 17D, in further embodiments, each extension 201 may comprise a portion of a fin 17D extending inwardly toward the centrifugal fan wheel. Stated another way, the "teeth" formed by the fin cutouts may face towards the centrifugal fan wheel as opposed to away from the central fan wheel (as illustrated in FIG. 19A). For instance, each cutout 202 may comprise a trapezoidal aperture extending radially outward from the inward peripheral circumference of the fin, for instance, the edge proximate to the fan, and toward the edge proximate to the outer surface. In various embodiments, the cutout extends radially outward to an outermost bound comprising a cutout floor line 205 comprising an outward boundary of the cutouts. Thus, one may appreciate that in such a configuration, the contiguous portion of the fin may be radially outboard of the extensions and cutouts so that the fin may be said to comprise an inverted fin, whereas in further embodiments, the contiguous portion of the fin may be radially inward of the extensions and the cutouts.

Moreover, in various embodiments, a recirculation scoop 300 may be disposed at least partially with the outside surface 131. A recirculation scoop 300 may comprise a structure configured to redirect a first portion of a fluid leaving the centrifugal fan outlet 135 back into the tube/fin array 100, wherein the first portion of the fluid is recirculated and further heat exchange effectuated, while a second portion of the fluid is permitted to exit via the centrifugal fan outlet 135. In this manner, by selectively positioning a recirculation scoop 300, the temperature of the fluid exiting the centrifugal fan outlet 135 may be calibrated in response to the subsequent mixing of the first portion of the fluid back into the fluid flowing through the tube/fin array 100 wherein further heat exchange occurs. In this manner, by selectively positioning a recirculation scoop 300, the humidity of fluid exiting the centrifugal fan outlet 135 may be calibrated in response to the subsequent mixing of the first portion of the fluid back into the fluid flowing through the tube/fin array 100, wherein further drying occurs. In addition, the duration of time in which a portion of the air is in contact with the fins may be calibrated, for instance, increased, in response to selectively positioning a recirculation scoop 300 to mix the portion of the air back into the air flowing through the tube/fin array 100.

In various embodiments, the recirculation scoop 105 may comprise a radial slot 103 and a circumferential member 102. The circumferential member 102 may further comprise an affixment stud 104 that extends into the radial slot 103, whereby the position of the circumferential member 102 may be adjusted by sliding the affixment stud 104 to different positions within the slot 103.

The circumferential member 102 may extend generally circumferentially about the centrifugal fan outlet 135. In this manner, a portion of the fluid leaving the centrifugal fan outlet 135 may be blocked from leaving and redirected back into the tube/fin array 100 by the circumferential member 102, and a portion of the fluid leaving the centrifugal fan outlet 135 maybe blocked from reentering the tube/fin array 100 and directed to exit via the centrifugal fan outlet 135. In various embodiments, the circumferential member 102 is further affixable in position by an affixment pivot 106. In various embodiments, the affixment pivot 106 is disposed at a distal end of the circumferential member 102 and comprises a pivot point about which the circumferential member 102 pivots as the affixment stud 104 is slidable in the slot 103. Thus, by selecting the positioning of affixment stud 104 within the slot 103, the relative amounts of fluid permitted to exit via the centrifugal fan outlet 135 and directed to recirculate, may be calibrated. In various embodiments, one or more of the affixment stud 104 and the affixment pivot 106 may be selectably movable, such as by a thermostat controlled servo, or any automated or manual means of adjustment, while in further embodiments, the affixment stud 104 and the affixment pivot 106 are permanently or temporarily affixed in position. Furthermore, the circumferential member 102 may comprise a solid scoop, or may have slots, or may be shorter, or longer, or tapered, or any shape as desired to direct the flow of air or cause more or less air to exit the fan or to recirculate within the fan.

In accordance with various embodiments of the invention, and illustrated in FIGS. 19A-B, 20, 22A-B, and 23, tube/fin array 100 may be configured as a single assembly comprising one or more fins 17B or fins 17C, contacting the first tube 14 and the second tube 15. In further examples, the fin 17B or fin 17C and first tube 14 and/or second tube 15 may be in intermittent parallel contact along a significant portion of the length of the fin 17B, 17C. For instance, fin 17C may include coining 200 (see FIG. 20) (e.g., alternate raising, such as a raised portion 301 and/or lowering such as a lowered portion 302) of the fin along the portion proximate to the first tube 14 and/or second tube 15 which may cause the fin 17C and first tube 14 and second tube 15 to be in intermittent parallel contact along the length of fin 17C, such as between raised portions 301, and/or between tips of lowered portions 302 along a significant portion of the length of the fin 17C. In this manner, a series of gaps 303 may be maintained between the fin 17B, 17C and first tube 14 and/or second tube 15, whereby condensate may be drainable from the tube/fin array 100. Moreover, while coining 200 is depicted as a series of triangular gaps 303, any shape may be contemplated, such as trapezoidal gaps, curved gaps, sinusoidal gaps, irregular gaps, or semi-circular gaps.

Various principles of the present invention have been described in exemplary embodiments. However, many combinations and modifications of the above-described structures, arrangements, proportions, elements, materials, and components, used in the practice of the invention, in addition to those not specifically described, can be varied without departing from those principles. Various embodiments have been described as comprising automatic processes, but this process may be performed manually without departing from the scope of the present invention. Furthermore, the benefits, advantages, solutions to problems, and any elements that may cause any benefit, advantage, or solution to occur or become more pronounced are not to be construed as critical, required, or essential features or elements of the invention. The scope of the invention is accordingly to be limited by nothing other than the appended claims, in which reference to an element in the singular is not intended to mean "one and only one" unless explicitly so stated, but rather "one or more." All structural and functional equivalents to the elements of the above-described exemplary embodiments that are known to those of ordinary skill in the art are expressly incorporated herein by reference and are intended to be encompassed by the present claims. Further, a list of elements does not include only those elements but may include other elements not expressly listed or inherent to such process, method, article, or apparatus.

The invention claimed is:

1. A fin array for use in a centrifugal fan having a housing and a fan wheel, the fin array comprising:

a first tube in a first plane perpendicular to an axis of the fan wheel;

a second tube in a second plane parallel to the first plane; and a fin in a third plane parallel to the first plane, wherein the fin, the first tube, and the second tube are partially surrounding the axis of the fan wheel, the fin having a first end and a second end, the fin having a length between the first end and the second end, wherein the fin is sandwiched between the first tube and the second tube, wherein the fin comprises a slotted fin apparatus for permitting condensate to move from a region between the fan wheel and the first tube to a region between the first tube and the housing;

wherein the slotted fin apparatus comprises:

a first extension and a second extension disposed along at least a portion of the length of the fin; and a first cutout disposed between the first extension and the second extension along the at least the portion of the length of the fin, wherein the first cutout is defined through the fin and bounded by the first extension and the second extension, wherein the first tube and the second tube are in parallel contact with the fin along at least a portion of the first extension.

2. The fin array according to claim 1, further comprising a first gap comprising an aperture defined by the first extension, the second extension, and at least one of the first tube and the second tube, whereby the aperture is configured to permit condensate to exit the fin array.

3. The fin array of claim 1, wherein the fin occupies a space between an exterior of the fan wheel and the housing.

4. The fin array of claim 1, wherein the fin is perpendicular to and wraps around a portion of the axis of the fan wheel approximately the same extent as the housing.

5. The fin array of claim 1, wherein the fin comprises a sectional auger fighting.

6. The fin array of claim 1, further comprising: a plurality of fins and tubes, wherein the plurality of fins and tubes are stacked continuing a pattern of the first tube, the fin and the second tube.

7. The fin array of claim 6, wherein every other tube in the plurality of tubes is configured to transport a first fluid while remaining tubes are configured to transport a second fluid.

8. The fin array of claim 1, wherein the fin is narrow on the first end and progressively widens to the second end.

9. A fin array for use in a centrifugal fan having a housing and a fan wheel, the fin array comprising:

a first tube in a first plane perpendicular to an axis of the fan wheel;

a second tube in a second plane parallel to the first plane;

a fin in a third plane parallel to the first plane, wherein the fin, the first tube, and the second tube are partially surrounding the axis of the fan wheel, the fin having a first end and a second end, the fin having a length between the first end and the second end, wherein the fin is sandwiched between the first tube and the second tube, wherein the fin comprises a slotted fin apparatus for permitting condensate to move from a region between the fan wheel and the first tube to a region between the first tube and the housing; and a recirculation scoop disposed at least partially within an outside surface of the housing, and configured to redirect a first portion of a fluid that would otherwise leave a centrifugal fan outlet back through the fin array.

10. The fin array of claim 9, wherein the recirculation scoop comprises:

a circumferential member configured to direct the first portion of the fluid back into the fin array;

an affixment stud extending from the circumferential member and received in a radial slot, whereby the circumferential member may be selectably moved; and an affixment pivot disposed at a distal end of the circumferential member, whereby the recirculation scoop is affixed in position.

* * * * *